US008146713B2

(12) United States Patent
Rosenthal

(10) Patent No.: US 8,146,713 B2
(45) Date of Patent: Apr. 3, 2012

(54) LIFTING APPARATUS AND METHOD FOR TRANSPORTING PEOPLE AND OBJECTS

(76) Inventor: Harry J. Rosenthal, Jackson, MS (US)

( * ) Notice: Subject to any disclaimer, the term of this patent is extended or adjusted under 35 U.S.C. 154(b) by 0 days.

(21) Appl. No.: 11/528,529

(22) Filed: Sep. 28, 2006

(65) Prior Publication Data

US 2008/0093176 A1 Apr. 24, 2008

(51) Int. Cl.

| | |
|---|---|
| ***B66B 9/08*** | (2006.01) |
| ***B66B 9/16*** | (2006.01) |
| ***B66F 9/02*** | (2006.01) |
| ***A61G 7/10*** | (2006.01) |

(52) U.S. Cl. ..... 187/245; 187/200; 187/240; 414/595; 414/921

(58) Field of Classification Search ..... 187/200–202, 187/240–244, 239, 245; 29/428; 414/921, 414/595; *B66B 9/08, 9/193; A61G 7/10*
See application file for complete search history.

(56) References Cited

U.S. PATENT DOCUMENTS

| | | | | | |
|---|---|---|---|---|---|
| 152,013 | A | * | 6/1874 | Seeburger | 187/241 |
| 174,631 | A | * | 3/1876 | King | 187/365 |
| 302,855 | A | * | 7/1884 | Lutz | 414/595 |
| 961,782 | A | * | 6/1910 | Liljeros | 187/242 |
| 1,358,062 | A | | 11/1920 | Davis | |
| 1,768,650 | A | | 7/1930 | Wood | |
| 1,838,204 | A | | 12/1931 | Wood | |
| 1,936,195 | A | * | 11/1933 | Honig | 182/141 |
| 2,516,726 | A | * | 7/1950 | Saxton et al. | 187/201 |
| 2,528,265 | A | | 10/1950 | Cretors | 187/12 |
| 2,563,260 | A | * | 8/1951 | Miller | 187/201 |
| 2,674,347 | A | | 4/1954 | Thompson | 187/12 |
| 2,832,436 | A | * | 4/1958 | Roberts | 187/201 |
| 2,950,948 | A | * | 8/1960 | Blanche et al. | 187/202 |
| 3,055,523 | A | * | 9/1962 | Wurn | 414/498 |
| 3,115,211 | A | * | 12/1963 | Ostrander, Jr. | 182/103 |
| 3,216,369 | A | * | 11/1965 | McKinney | 104/176 |
| 3,428,145 | A | * | 2/1969 | Lyon | 182/103 |
| 3,500,963 | A | * | 3/1970 | Beutler | 187/289 |
| 3,592,294 | A | * | 7/1971 | Allen | 187/241 |
| 3,662,859 | A | | 5/1972 | Flinchbaugh | 187/12 |
| 3,749,202 | A | * | 7/1973 | Puls | 187/201 |
| 3,891,062 | A | * | 6/1975 | Geneste | 187/245 |
| 4,043,427 | A | | 8/1977 | Ackerman | 187/12 |
| 4,046,226 | A | | 9/1977 | Flinchbaugh | 187/12 |
| 4,345,669 | A | | 8/1982 | Noall | 187/10 |
| 4,438,830 | A | | 3/1984 | Born | 187/12 |
| 4,977,981 | A | * | 12/1990 | Paquin | 187/200 |
| 5,050,708 | A | * | 9/1991 | Wood | 187/201 |
| 5,105,741 | A | * | 4/1992 | Leary | 104/106 |
| 5,553,548 | A | | 9/1996 | Eaton | 104/183 |
| 5,624,009 | A | | 4/1997 | Benjamin et al. | 187/201 |
| 6,095,284 | A | | 8/2000 | Smith | 182/103 |

(Continued)

FOREIGN PATENT DOCUMENTS

DE 3213774 A1 * 10/1983

(Continued)

*Primary Examiner* — Emmanuel M Marcelo
*Assistant Examiner* — Stefan Kruer
(74) *Attorney, Agent, or Firm* — Kratz, Quintos & Hanson, LLP

(57) ABSTRACT

A lifting apparatus including a travel platform moving along a support frame to transport people and objects, and a lifting method for moving the travel platform up and down along the support frame to transport people and objects.

13 Claims, 29 Drawing Sheets

U.S. PATENT DOCUMENTS

| | | | | |
|---|---|---|---|---|
| 6,360,833 | B1 | 3/2002 | Valencia | 180/7.5 |
| 6,419,050 | B1 * | 7/2002 | Sardonico | 187/244 |
| 6,854,147 | B1 | 2/2005 | Ahlsten | 14/69.5 |
| 7,395,900 | B2 * | 7/2008 | Murray et al. | 187/200 |

FOREIGN PATENT DOCUMENTS

| | | | | |
|---|---|---|---|---|
| DE | 3923473 | A1 | * | 1/1991 |
| EP | 1 029 763 | A1 | | 8/2000 |
| FR | 2726816 | A1 | * | 5/1996 |
| GB | 1 445 570 | | | 8/1976 |
| GB | 1 512 779 | | | 6/1978 |
| JP | 6-278665 | | | 10/1994 |
| JP | 2000063059 | A | * | 2/2000 |
| JP | 2000143200 | A | * | 5/2000 |
| JP | 2001158582 | A | * | 6/2001 |
| JP | 2003160287 | A | * | 6/2003 |
| JP | 2005001883 | A | * | 1/2005 |
| JP | 2005239289 | A | * | 9/2005 |

* cited by examiner

LIFTING APPARATUS AND METHOD FOR TRANSPORTING PEOPLE AND OBJECTS

BACKGROUND

1. Technical Field

The present invention relates to a lifting apparatus and method for transporting people and objects, and more particularly to a lifting apparatus and method for transporting handicapped individuals with wheelchairs, individuals without wheelchairs, and other objects.

2. Related Art

I have found that presently there is a need for a lifting apparatus and method for transporting people and objects.

Efforts have been made to provide a lifting apparatus and/or a lifting method. Exemplars of efforts are disclosed, for example, in U.S. Pat. No. 3,662,859 for Stairway Elevator issued to Flinchbaugh, U.S. Pat. No. 5,553,548 for System and Method for Moving an Occupied Wheelchair Between Two Levels issued to Eaton, U.S. Pat. No. 6,854,147 for Loading Ramp Apparatus issued to Ahlsten, U.S. Pat. No. 4,043,427 for Stair Elevator issued to Ackerman, UK Patent No. 1,445,570 for Improved Stairlift issued to Dooley, European Patent No. 1,029,763 A1 for Installation for Transporting Persons Especially for Invalids, and Construction of this Installation Especially Based on an Escalator issued to Lorton, U.S. Pat. No. 4,438,830 for Stairway with Fail Safe Power Lift for Lading, the Infirm, Wheelchair Patients, and the like issued to Born, UK Patent No. 1,512,779 for improvements in Stair Lifts issued to Chapman, U.S. Pat. No. 2,563,260 for Inclined Elevator issued to Miller, U.S. Pat. No. 4,345,669 for Wheelchair Lift issued to Noall, U.S. Pat. No. 5,050,708 for Wheelchair Transfer Mechanism issued to Wood, U.S. Pat. No. 2,674,347 for Stair Elevator issued to Thompson, U.S. Pat. No. 6,360,833 for Chair Lift for Stairs issued to Valencia, U.S. Pat. No. 5,624,009 for Wheelchair Lift issued to Benjamin et al., U.S. Pat. No. 6,095,284 for Elevatable Stands for Physically Challenged Hunters issued to Smith, U.S. Pat. No. 1,358,062 for Stairway Elevator issued to Davis, U.S. Pat. No. 1,768,650 for Inclined Elevator issued to Wood, U.S. Pat. No. 1,838,204 for Inclined Elevator issued to Wood, U.S. Pat. No. 2,528,265 for Elevator Mechanism issued to Cretors, U.S. Pat. No. 4,046,226 for Elevator System for Transporting Wheelchair Patients issued to Flinchbaugh, and Japanese Patent No. 06-278665 for Guide Device for Stairway Lift issued to Rintaro.

While these efforts provide value, it is my observation that further improvements can also be contemplated.

SUMMARY OF THE INVENTION

The present invention provides a novel and elegant approach to providing an improved lifting apparatus and method for transporting people and objects.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments and features of the present invention are illustrated, which, together with the general description given above, and the detailed description given below, serve to exemplify the principles of the present invention.

DETAILED DESCRIPTION OF THE INVENTION

While the present invention will be described more fully hereinafter with reference to the accompanying drawings, in which details of the present invention are shown, it is to be understood at the outset of the description which follows that persons of skill in the appropriate arts may modify the invention here described while still achieving the favorable results of this invention. Accordingly, the description of the best mode contemplated of carrying out the invention, which follows, is to be understood as being a broad, teaching disclosure directed to persons of skill in the appropriate arts, and not as limiting upon the present invention.

Illustrative embodiments of the best mode of carrying out the invention are described below. In the interest of clarity, not all features of an actual implementation are described. In the following description, well-known functions, constructions, and configurations are not described in detail since they could obscure the invention with unnecessary detail. It will be appreciated that in the development of any actual embodiment numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure. Additionally, aspects of the embodiments disclosed can be combined.

Figure 1:
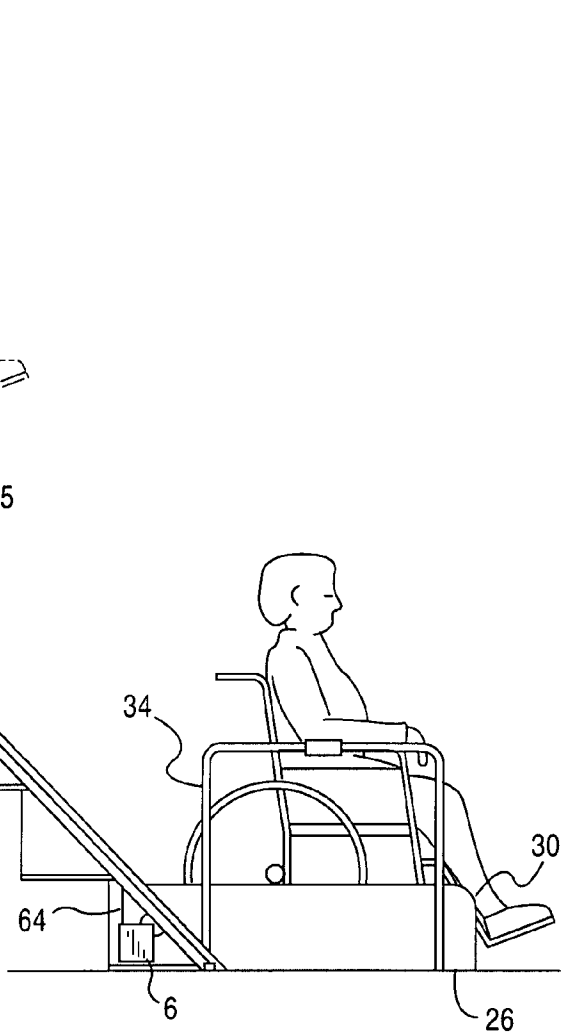
FIG. 1 is a side view of one embodiment of a lifting apparatus, in accordance with the principles and features set forth in the subject application.

FIG. 1 is a side view of one embodiment of a lifting apparatus, in accordance with the principles and features set forth in the subject application.

As shown in FIG. 1, there is a lifting apparatus 5 which has a travel platform 84 that goes up and down. The lifting apparatus 5 can be placed over a standard staircase 16, and can transport people and/or objects upward over the staircase 16, and can transport people and/or objects downward over the staircase.

To install the lifting apparatus 5 at the staircase 16, the lifting apparatus 5 is merely placed over the staircase 16. Typically, no special hardware or tools would be needed for the installation. To remove the lifting apparatus 5 from the staircase 16, or to uninstall the lifting apparatus 16, the lifting apparatus 5 is merely lifted up and taken away from the staircase 16. Typically, no special hardware or tools would be needed for the removal or uninstallation.

The size of the lifting apparatus 5 can be adjusted and customized, so that the lifting apparatus 5 can used at staircases having non-standard lengths. Furthermore, the lifting apparatus 5 can be used in a variety of different locations and situations, and is not limited only to a use over a staircase. For example, if a new house is being constructed, and there is a gap between the first and second floors, and no staircase has not been built yet, the lifting apparatus 5 can be used to transport people and/or objects between those two floors in that house. There are many other situations and locations at which the lifting apparatus 5 could be used.

FIG. 1 depicts a lifting apparatus 5 having an upper rail 2 on a left side, a lower rail 4 on a left side, a leg 8 at the top of the rails, a foot 10 under leg 8, staircase 16, winch 6, cable 64, and travel platform 84. A person can get onto the travel platform 84, and then be transported from a first floor of a house to a second floor of a house over a staircase, for example. The lifting apparatus 5 is portable and can be powered by a rechargeable battery connected thereto, or can be powered by an external power source. The travel platform 84 can also be referred to as a platform 84 or movable unit 84, for example. FIG. 1 also shows a person on a wheelchair rolling onto the travel platform 84 at an upper floor, such that the person and the wheelchair are then moved from the upper floor to a lower floor by the travel platform 84.

Figure 2:
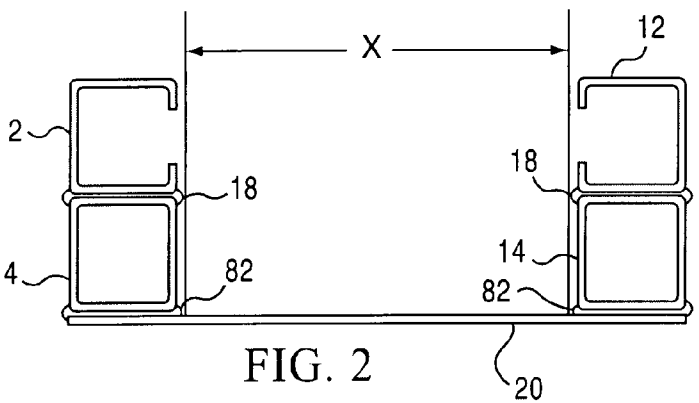
FIG. 2 is a view of the rails and a cross-bar of the lifting apparatus of FIG. 1.

FIG. 2 is a view of the rails and a cross-bar of the lifting apparatus of FIG. 1. As shown in FIG. 2, there is depicted an end view of the upper rail 2 on the left side and lower rail 4 on the left side, and also an end view of an upper rail 12 on the right side, lower rail 14 on the right side, welds 18 and 82, and a cross-bar 20 between rails.

In FIG. 2, the distance X is a distance that is needed to accommodate a user of the lifting apparatus 5. The distance X could be set to be in the range of 24 inches if a wide wheelchair will not be placed on the travel platform 84. The distance X could be set to be 36 or 38 inches if a wide wheelchair, or a large item such as a refrigerator, will be placed on the travel platform 84.

Figure 3:
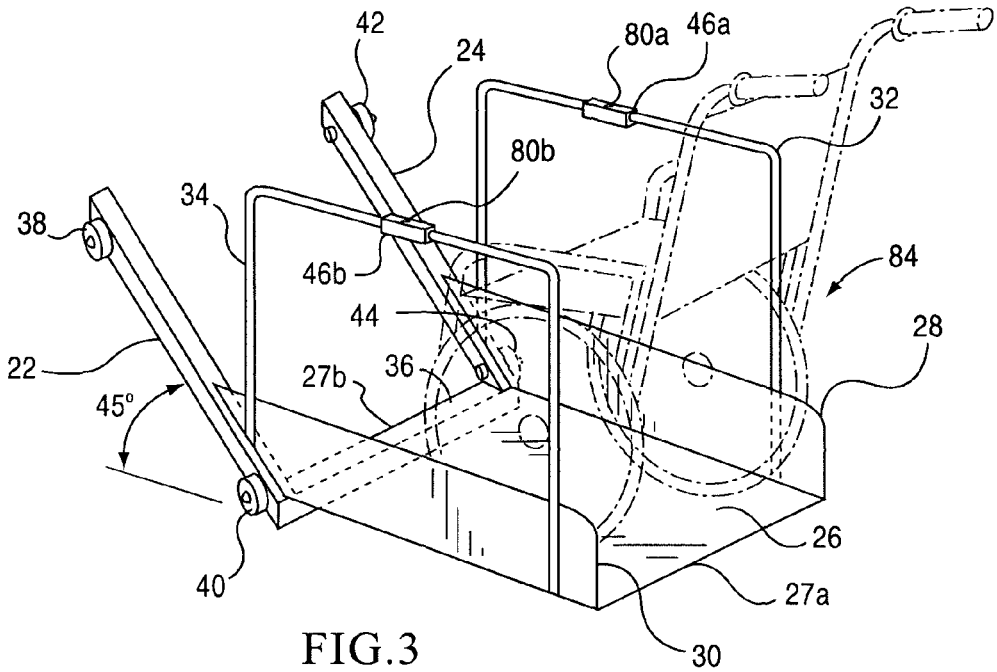
FIG. 3 is a view of the travel platform of the lifting apparatus of FIG. 1, with handrails.

FIG. 3 is a view of the travel platform of the lifting apparatus of FIG. 1, with handrails. As shown in FIG. 3, there is depicted the travel platform 84, which has a floor portion 26, a right side wall 28, a left side wall 30, a support piece 36 under the floor portion 26, a left upright portion 22, a right upright portion 24, a right handrail 32, a left handrail 34, wheel assemblies 38 and 40 on left upright portion 22, wheel assemblies 42 and 44 on right upright portion 24, right control unit 46*a*, left control unit 46*b*, control switch 80*a* on right control unit 46*a* on right handrail 32, and control switch 80*b* on left control unit 46*b* on left handrail 34. The control switches 80*a* and 80*b* can be operated by a person on the travel platform, and control movement of the travel platform. FIG. 3. also shows a wheelchair on the travel platform 84.

The support piece 36 is located under the floor portion 26, which makes it easier to roll a wheelchair onto and off from the travel platform 84. For example, a typical house may have a first floor, a second floor, and a staircase 16 connecting the two floors. The lifting apparatus 5 can be placed over the staircase 16. When the travel platform 84 is at the first floor, a person in a wheelchair can roll the wheelchair onto the floor portion 26 over the front edge 27*a* of the floor portion 26. Then a control switch 80*a* is operated to cause the travel platform 84 to carry the person in the wheelchair up to the second floor. At that time, the person in the wheelchair can roll the wheelchair off of the floor portion 26 over the rear edge 27*b* of the floor portion 26. Because the support piece 36 is under the floor portion 26, the person in the wheelchair does not need to go over a bump at the rear edge 27*b* of the floor portion 26.

In order to install the lifting apparatus 5, all that a person needs to do is merely place the lifting apparatus 5 over the staircase 16. After the lifting apparatus 5 is placed over any staircase, the lifting apparatus 5 is ready for operation.

It is not necessary to make any substantial modifications to any portion of the house during installation of the lifting apparatus 5, during operation of the lifting apparatus 5, or during removal of the lifting apparatus 5. Drilling a hole in a wall, floor, stair, or other surface would constitute a substantial modification. Driving a screw into a wall, floor, stair, or other surface would constitute a substantial modification. Hammering a nail into a wall, floor, stair, or other surface would constitute a substantial modification. Cutting a portion of a wall, floor, stair, or other surface would constitute a substantial modification.

Figure 24:
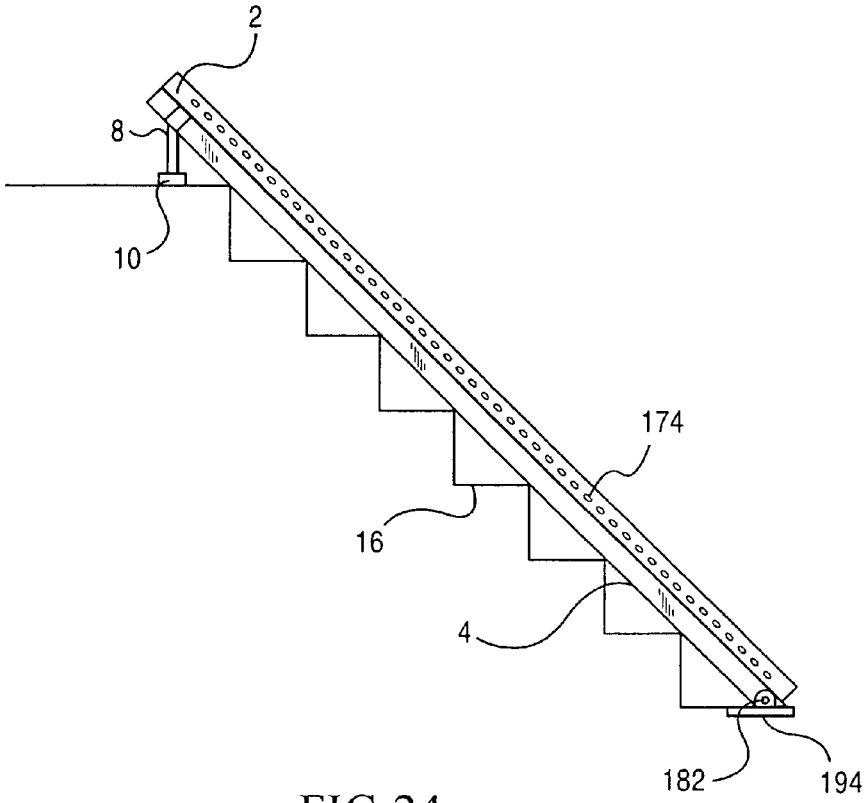
FIG. 24 is a side view of one embodiment of a lifting apparatus, in accordance with the principles and features set forth in the subject application, with oval holes in a rail.

According to the principles as disclosed in the subject application, installing, operating, and removing/uninstalling the lifting apparatus 5 at a staircase 16 can be performed without modifying any wall, floor, stair, or other surface. To install the lifting apparatus 5, the lifting apparatus 5 can be merely placed over a staircase. Feet 10 will rest on the second floor and rubber cushions 194 will rest on the first floor, as shown in FIG. 24. No damage is done to any wall, floor, stair, or other surface during installation, operation, or removal/uninstallation. No substantial changes are made to any wall, floor, stair, or other surface during installation, operation, or removal/uninstallation.

Figure 4:
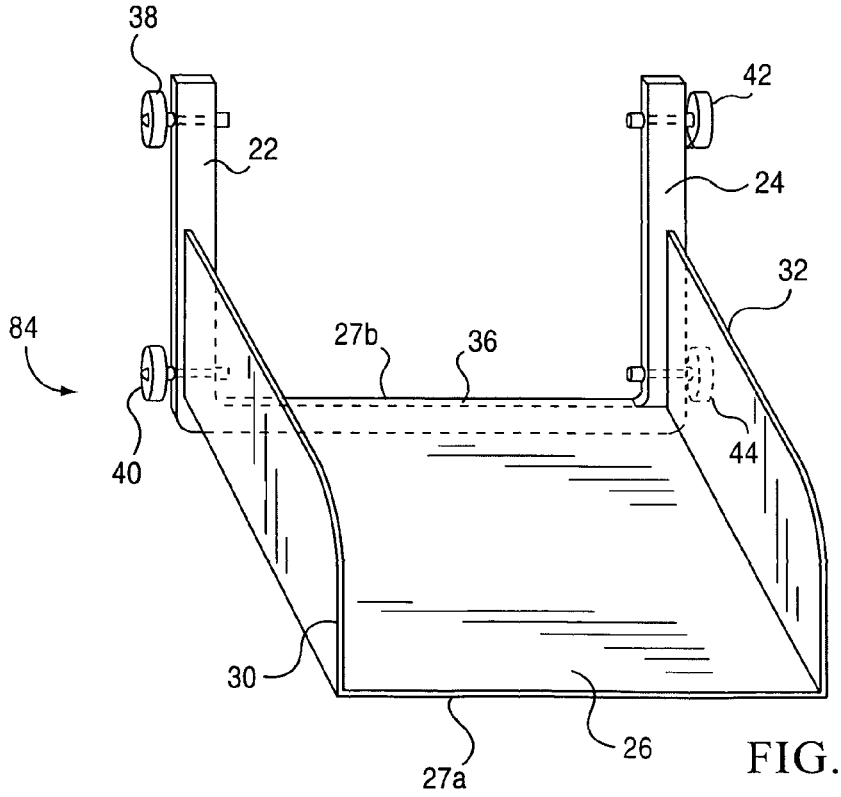
FIG. 4 is a view of the travel platform of the lifting apparatus of FIG. 1, without handrails.

FIG. 4 is a view of the travel platform of the lifting apparatus of FIG. 1, without handrails. As shown in FIG. 4, since there are no handrails, a control unit is not mounted on a handrail. Instead of using a handrail-mounted control unit, the control of the movement of the travel platform 84 can be performed using a handheld control unit.

Figure 5:
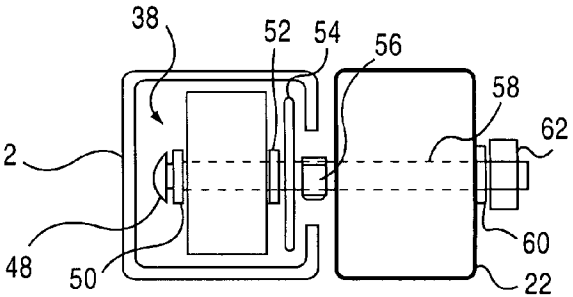
FIG. 5 is a view of a wheel assembly of the lifting apparatus of FIG. 1, with a wheel located inside a rail, with the wheel mounted to the travel platform.

FIG. 5 is a view of a wheel assembly of the lifting apparatus of FIG. 1, with a wheel located inside a rail, with the wheel mounted to the travel platform. The FIG. 5 depicts an end view of left upper rail 2, and also a wheel assembly 38 inside rail 2, left upright portion 22 of the travel platform 84, and different portions of the wheel assembly 38. The wheel assembly 38 can include components such as a head of a bolt 48, washers 50, 52, and 54, nut 56, shaft 58, washer 60, and nut 62, for example. The wheel assembly 38 is mounted to the left upright portion 22 of the travel platform 84, and is positioned inside a hollow portion of left upper rail 2. As the travel platform 84 is raised upward to a top of the staircase 16, the wheel of the wheel assembly 38 rolls in the left upper rail 2 to facilitate movement of the travel platform 84.

Figure 6A:
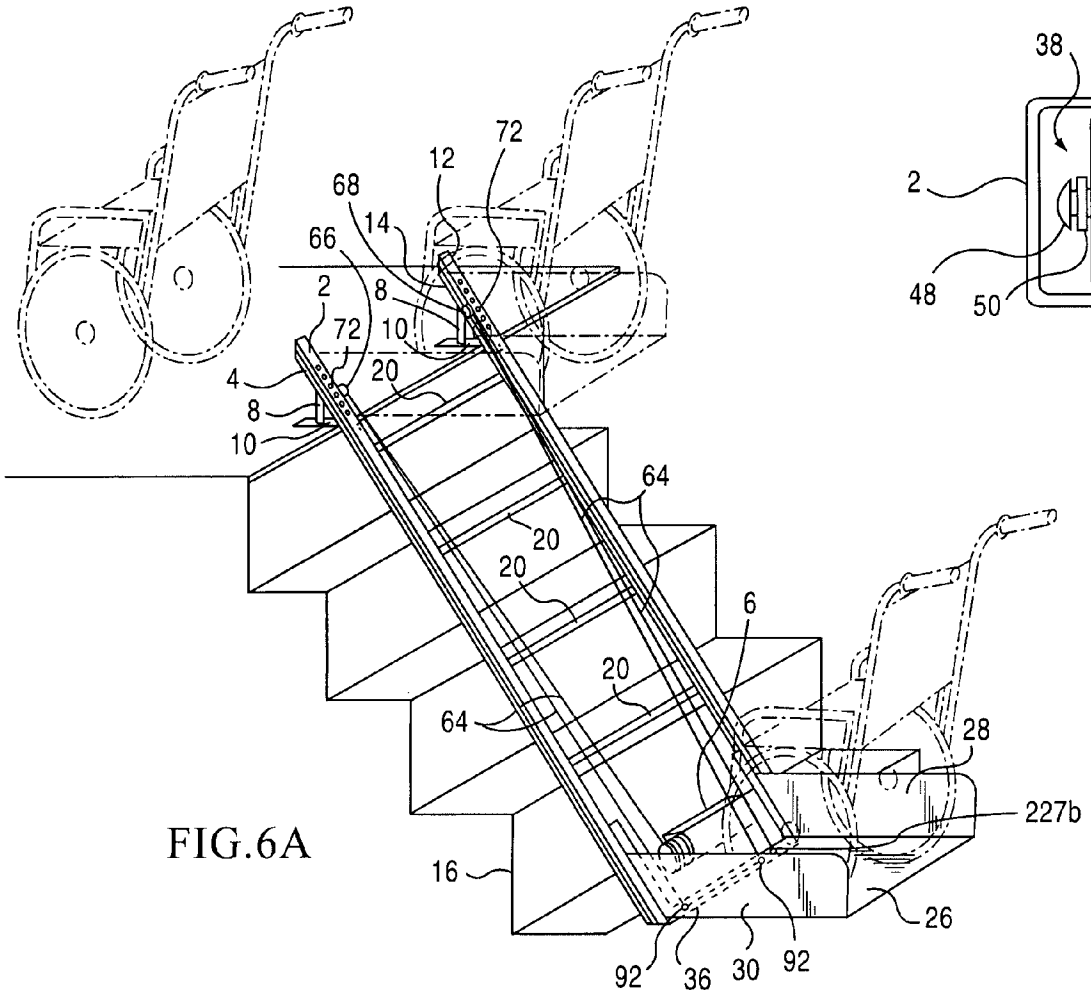
FIG. 6A is a view of one embodiment of a lifting apparatus, in accordance with the principles and features set forth in the subject application, with a cable located outside rails, with the cable arranged to be able to transport a standard weight up and down stairs.
Figure 6B:
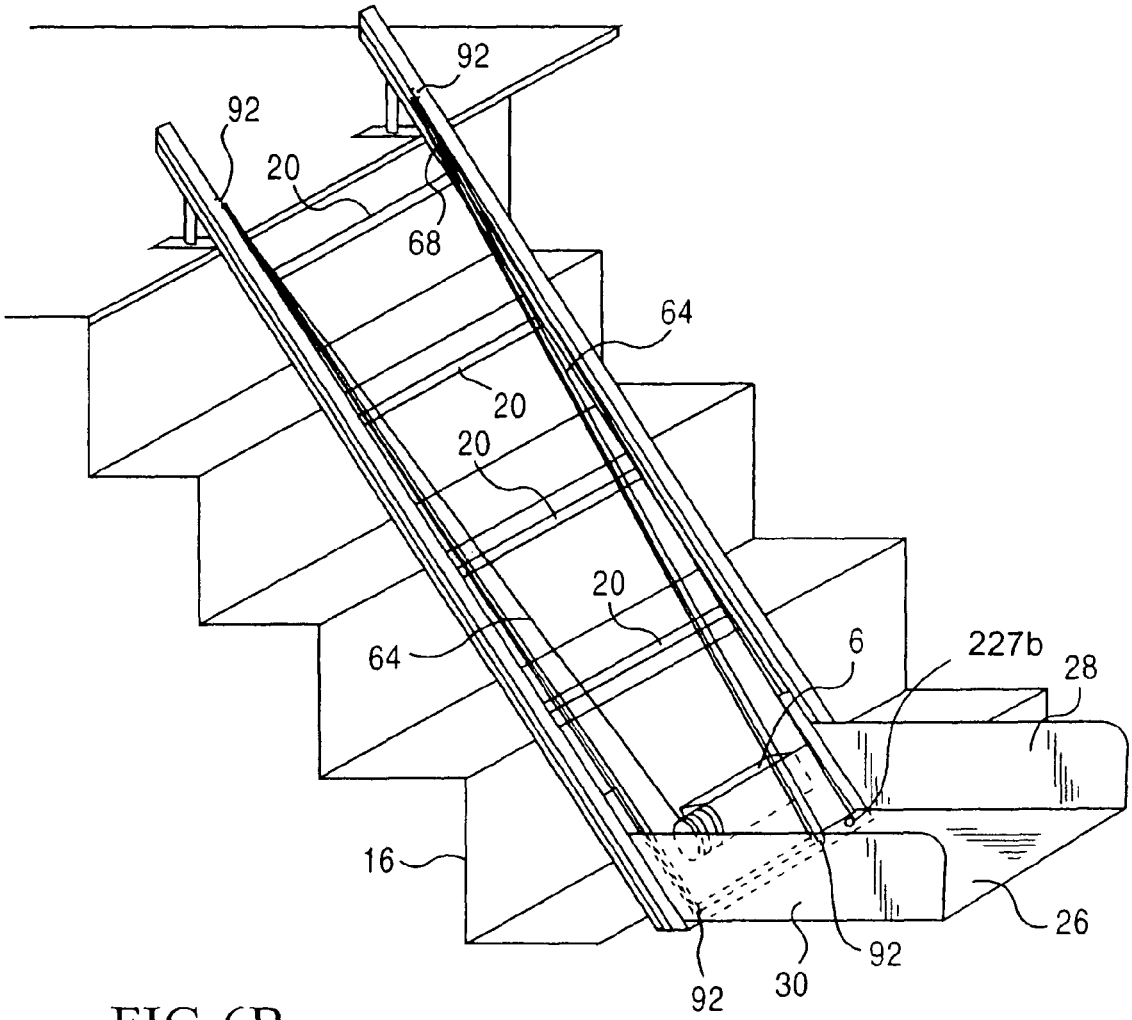
FIG. 6B is a view of one embodiment of a lifting apparatus, in accordance with the principles and features set forth in the subject application, with a cable located outside rails, with the cable arranged to be able to transport an extra heavy weight up and down stairs.

FIG. 6A is a view of one embodiment of a lifting apparatus, in accordance with the principles and features set forth in the subject application, with a cable located outside rails, with the cable arranged to be able to transport a standard weight up and down stairs. The arrangement of the cable 64 depicted in FIG. 6B is an arrangement intended to provide a standard or regular lifting capability, for the transport of standard weights up and down. The FIG. 6A depicts a lifting apparatus with the travel platform 84 at a bottom of the staircase 16. The FIG. 6A also shows a wheelchair on the travel platform 84, such that the wheelchair is moved from a lower floor to an upper floor by the travel platform 84, and such that the wheelchair is then rolled off the travel platform 84 onto the upper floor.

Figure 32:
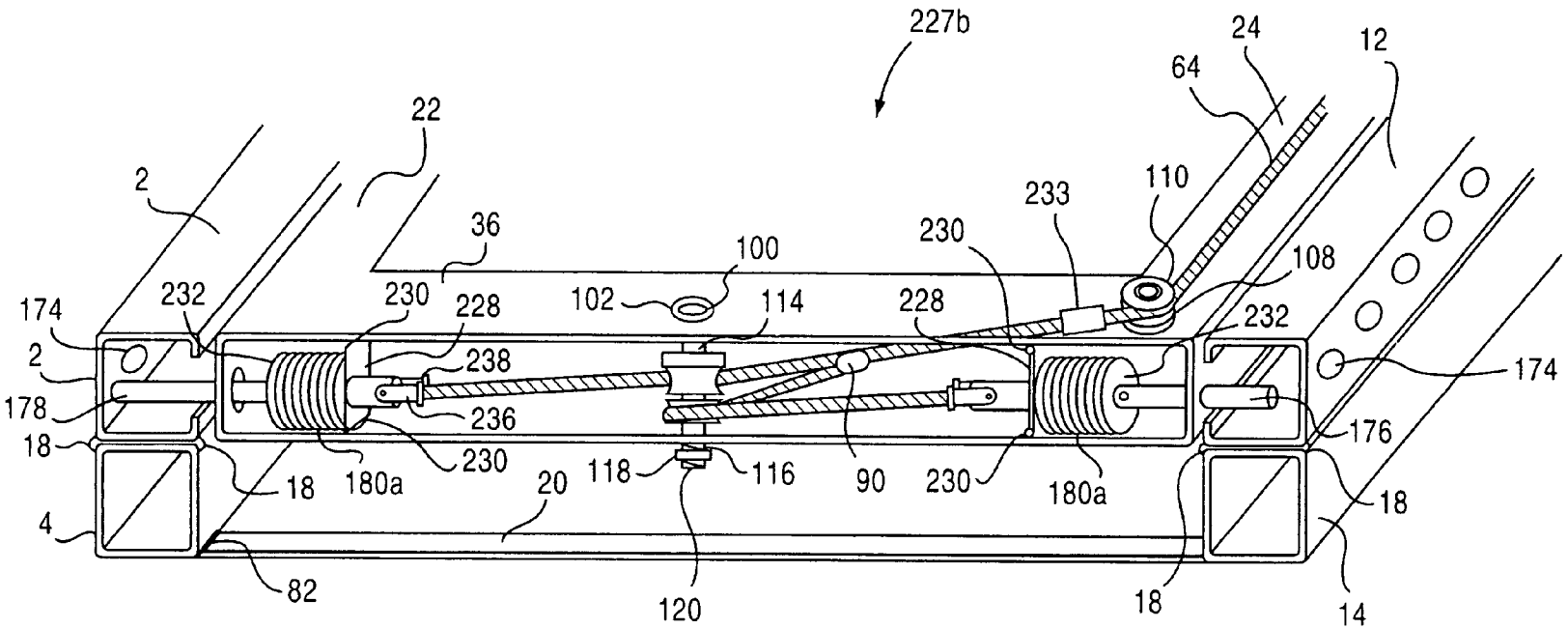
FIG. 32 is a view of portions of a second embodiment of a braking unit of a lifting apparatus, in accordance with the principles and features set forth in the subject application, when a cable of the lifting apparatus has not failed.

As shown in FIG. 6A, the path of cable 64 is as follows. The cable 64 is shown to extend up from the winch 6 to a wheel of a pulley assembly 66 near the top of the left upper rail 2. Then the cable 64 goes partly around the wheel of the pulley assembly 66 near the top of rail 2 and down to a wheel of a first pulley assembly 92 at the support piece 36 of the travel platform 84, wherein the first pulley assembly 92 is at the support piece 36 at a location near rail 2. Then the cable 64 goes through an interior of the support piece 36 to a wheel of a second pulley assembly 92. Then the cable 64 goes partly around the wheel of the second pulley assembly 92 and up to a wheel of the pulley assembly 68 near the top of the right upper rail 12. Then the cable 64 goes partly around the wheel of the pulley assembly 68 and back down to braking unit 227*b* at the travel platform 84. Details of the braking unit 227*b* are shown in FIG. 32. This arrangement of the cable 64 provides a regular lifting capability, intended for the transport of standard weights up and down.

The winch 6 can include various additional components and features. It should be helpful to refer to the winch 6 using a more general term, such as device 6. The device 6 includes a unit that pulls in cable and lets out cable, such as a winch unit or other unit. The device 6 can also include a large number of other components, such as a rechargeable power supply 196, a controller 276 which controls the operations of the winch and which has a wireless transceiver, a plug 208 for an external power source, and other components.

Pulley assembly 66 can be either inside rail 2, outside rail 2, or partly inside and partly outside rail 2. Pulley assembly 68 can be either inside rail 12, outside rail 12, or partly inside and partly outside rail 12.

The two pulley assemblies 92 shown in FIG. 6A can be either inside support piece 36, outside support piece 36, or partly inside and partly outside support piece 36.

Holes 72 are shown in the top of rail 2. These holes allow the pulley assembly 66 to be repositioned at a different height along rail 2. Holes 72 are shown in the top of rail 12. These holes allow the pulley assembly 68 to be repositioned at a different height along rail 2. The position of the legs 8 can also be altered. Because of this flexibility, the lifting apparatus can be modified to fit over staircases of different sizes.

Figure 29:
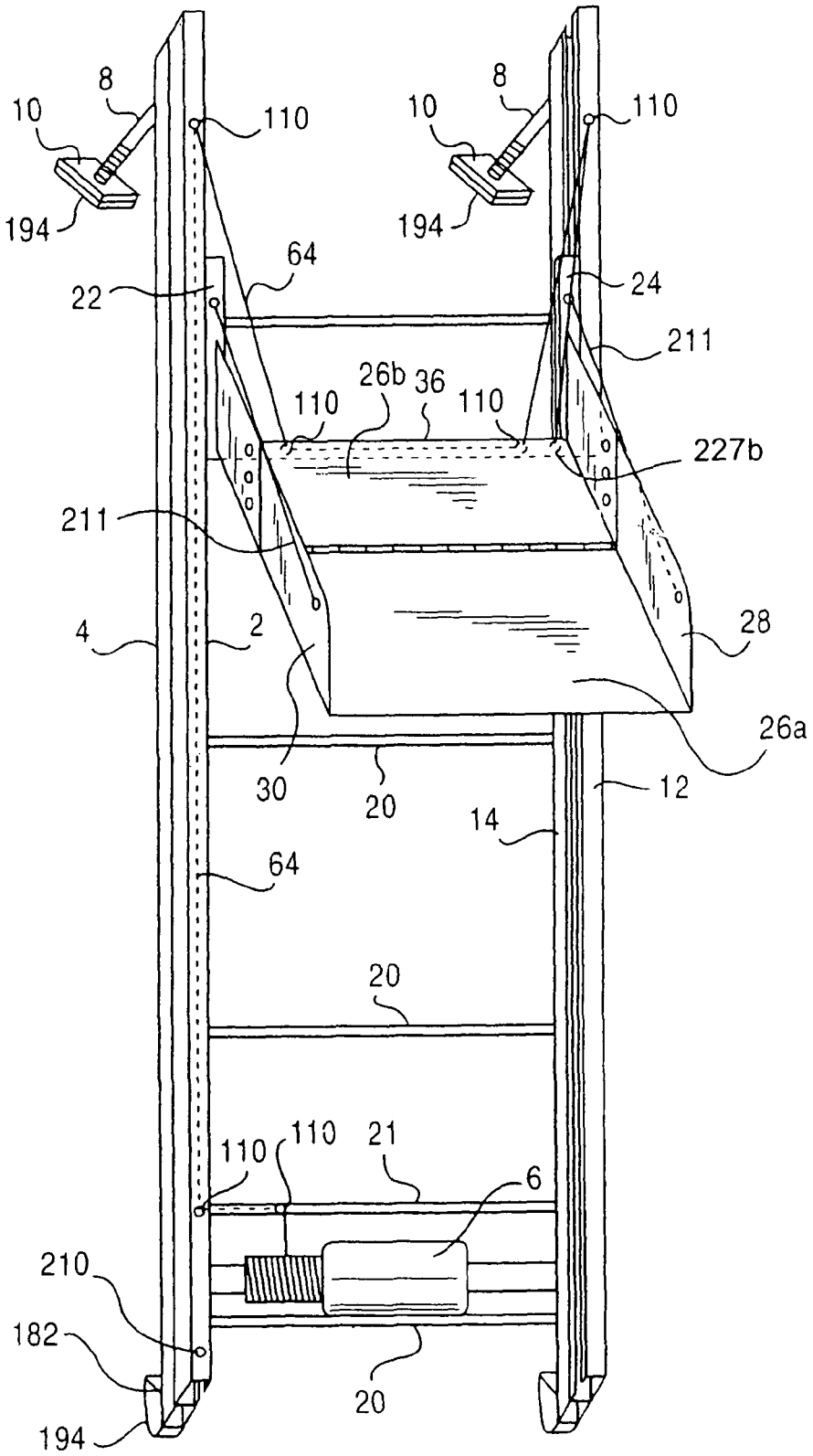
FIG. 29 is a view of one embodiment of a lifting apparatus, in accordance with the principles and features set forth in the subject application, with a foldable travel platform in a standard position.

As shown in FIG. 6A, the cable 64 is located outside of rail 2 between device 6 and pulley assembly 66. However, cable 64 can be arranged to be inside of the rail 2 between device 6 and the pulley assembly 66. For example, as shown in FIG. 29, cable 64 is located inside rail 2 between a first pulley assembly 110 at a lower region of rail 2 and a second pulley assembly 110 at an upper region of rail 2.

As shown in FIG. 6A, the cable 64 is located outside of rail 12 between pulley assembly 68 and a pulley assembly 92. However, cable 64 can be arranged to be inside of the rail 12.

FIG. 6B is a view of one embodiment of a lifting apparatus, in accordance with the principles and features set forth in the subject application, with a cable located outside rails, with the cable arranged to be able to transport an extra heavy weight up and down stairs. The FIG. 6B shows the lifting apparatus with the travel platform 84 at the bottom of the staircase 16. The arrangement of the cable 64 depicted in FIG. 6B is an arrangement intended to provide an extra lifting capability, for the transport of heavier weights up and down.

Figure 8:
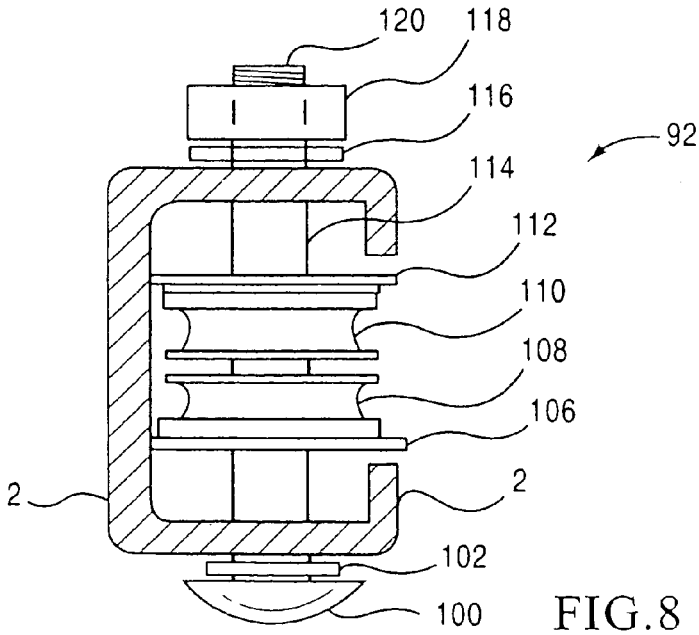
FIG. 8 is a view of a pulley assembly of the lifting apparatus of FIG. 6B.
Figure 11:
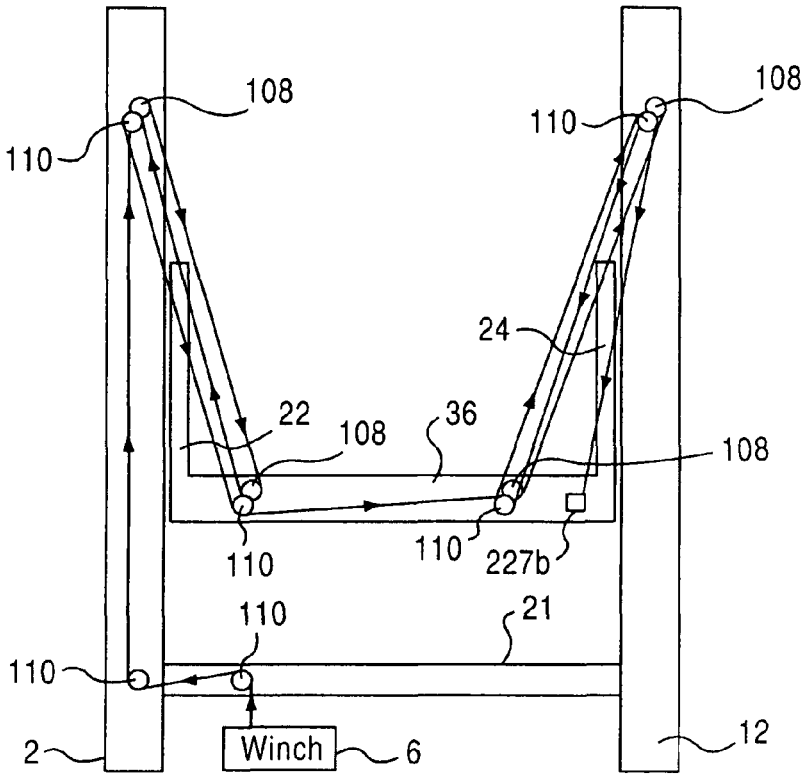
FIG. 11 is a view of pulley assemblies and a path of a cable of one embodiment of a lifting apparatus, in accordance with the principles and features set forth in the subject application, with the cable arranged to have an extra lifting capability and be able to transport a heavier weight up and down stairs.

The path of the cable 64 shown in FIG. 6B shall be described as follows. The cable 64 extends up from device 6 to a rotating wheel 108 of a first pulley assembly 92, near the top of rail 2. FIGS. 8 and 11 show an embodiment of a rotating wheel 108 of the first pulley assembly 92. Then the cable 64 goes partly around the wheel 108 of the first pulley assembly 92. Then the cable 64 goes down to a rotating wheel 108 of a second pulley assembly 92, at a left side of the support piece 36 of the travel platform 84. Then the cable 64 goes partly around the wheel 108 of the second pulley assembly 92. Then the cable 64 goes up to a rotating wheel 110 of the first pulley assembly 92, near the top of rail 2. FIGS. 8 and 11 show an embodiment of the rotating wheel 110 of the first pulley assembly 92.

Then the cable 64 goes partly around the wheel 110 of the first pulley assembly 92. Then the cable 64 goes down to a rotating wheel 110 of the second pulley assembly 92, at the left side of the support piece 36.

Then the cable 64 goes partly around the wheel 110 of the second pulley assembly 92, at the left side of the support piece 36. Then the cable goes through an interior of the support piece 36 to a rotating wheel 108 of a third pulley assembly 92, at a right side of the support piece 36. Then the cable 64 goes partly around the wheel 108 of the third pulley assembly 92.

Then the cable 64 goes up to a rotating wheel 108 of a fourth pulley assembly 92, near the top of the right upper rail 12. Then the cable 64 goes partly around the wheel 108 of the fourth pulley assembly 92. Then the cable 64 goes down to a rotating wheel 110 of the third pulley assembly 92, at the right side of the support piece 36. Then the cable 64 goes partly around the wheel 110 of the third pulley assembly 92.

Then the cable 64 goes up to a wheel 110 of the fourth pulley assembly 92, near the top of the right upper rail 12. Then the cable 64 goes partly around the wheel 110 of the fourth pulley assembly 92. Then the cable goes down to a braking unit 227*b* at the travel platform 84. Details of the braking unit 227*b* are shown in FIG. 32.

The above described pulley assemblies 92 can be inside rails 2, 12 and/or the support piece 36. Pulley assemblies 92 can be outside rails 2, 12 and/or the support piece 36.

Figure 7:
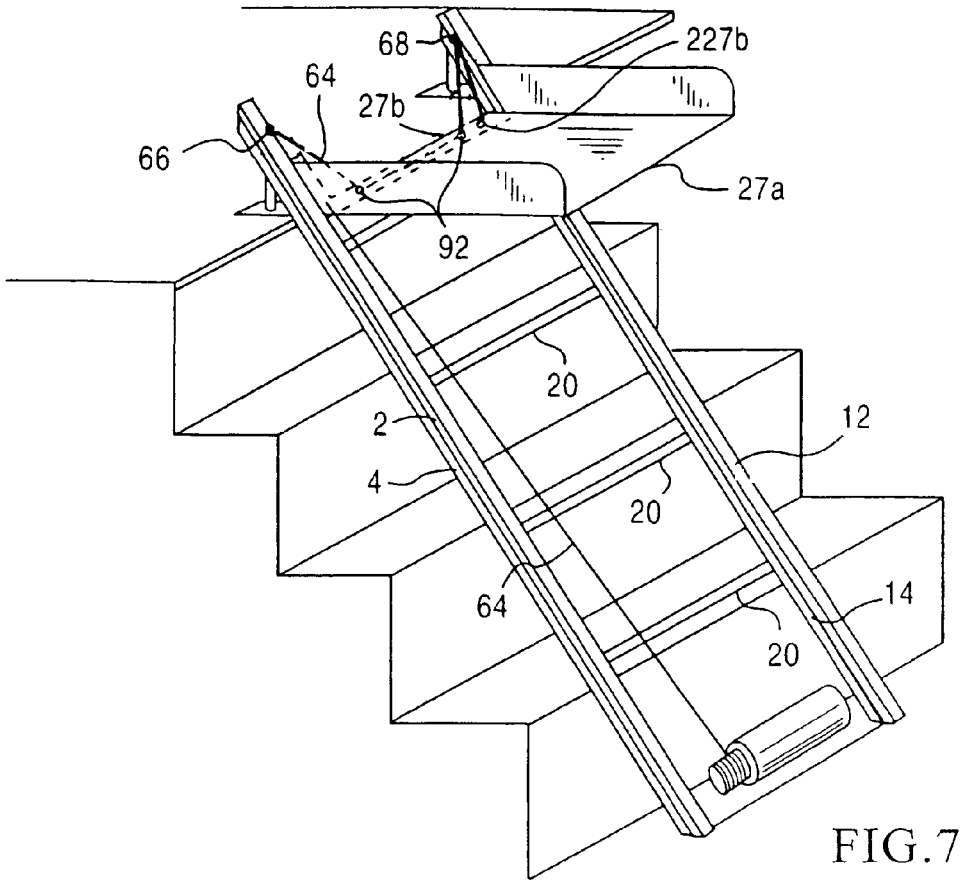
FIG. 7 is a view of one embodiment of a lifting apparatus, in accordance with the principles and features set forth in the subject application, with the travel platform at the top of the stairs.

FIG. 7 is a view of one embodiment of a lifting apparatus, in accordance with the principles and features set forth in the subject application, with the travel platform at the top of the stairs. The FIG. 7 shows a travel platform at the top of the stairs, such that a wheelchair would be able to roll off the floor portion 26 over the rear edge 27*b* to get to the second floor. Such a wheelchair would be able to roll off the floor portion 26 without needing to go over any significant bump or ridge.

The cable arrangement as shown in FIG. 7 is similar to the cable arrangement shown in FIG. 6A, providing a standard or regular lifting capability.

FIG. 8 is a view of a pulley assembly of the lifting apparatus of FIG. 6B. The FIG. 8 shows an end view of a upper left rail 2, with a pulley assembly 92 mounted therein. The pulley assembly 92 includes components such as head of bolt 100, washer 102, rotating wheel 108, rotating wheel 110, shaft of bolt 114, washer 116, nut 118, exposed end of shaft 120, and shield portions 106 and 112, for example.

Figure 9:
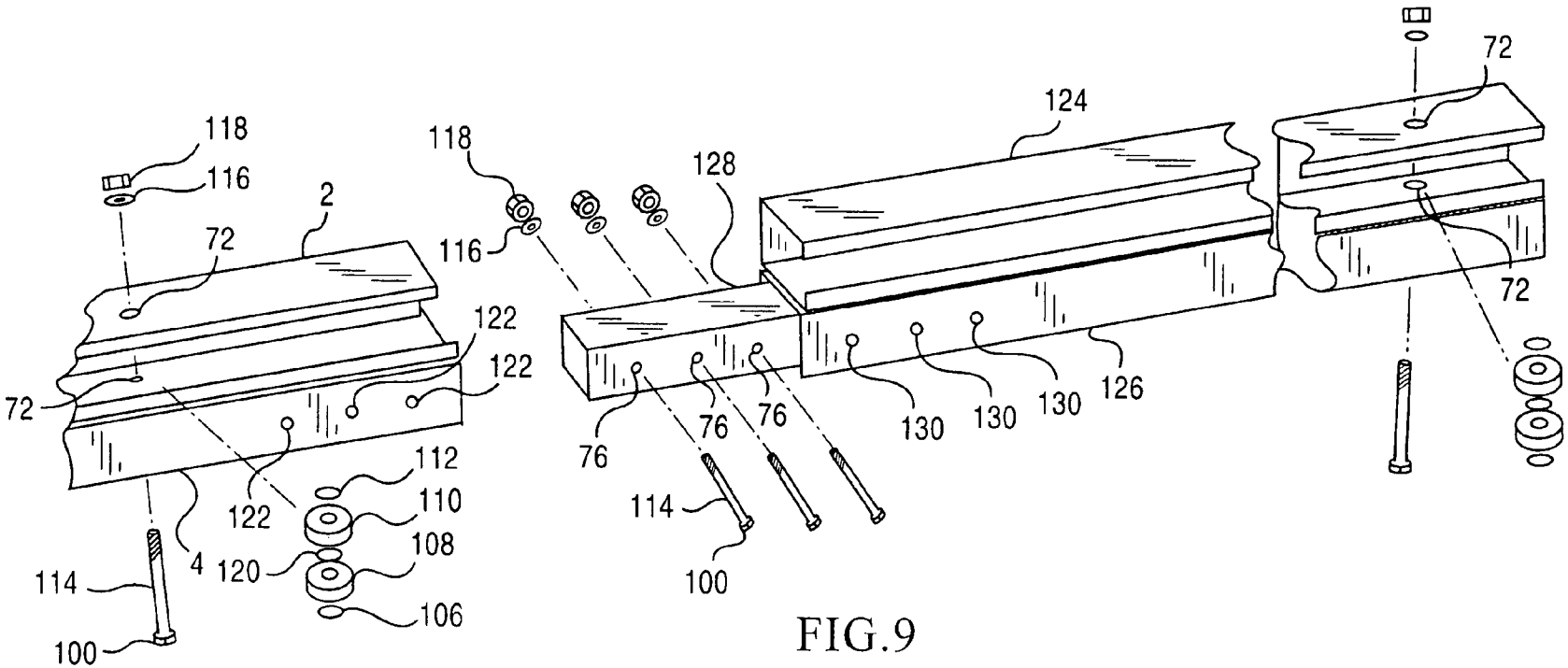
FIG. 9 is a view of modular extension rails for one embodiment of a lifting apparatus, in accordance with the principles and features set forth in the subject application, which allow the length of the lifting apparatus to be modified.

FIG. 9 is a view of modular extension rails for one embodiment of a lifting apparatus, in accordance with the principles and features set forth in the subject application, which allow the length of the lifting apparatus to be modified. The FIG. 9 shows how the overall length of the lifting apparatus can be modified in order to fit over a particular staircase. The lifting apparatus can be lengthened by adding extension rails to the rails 2, 4, 12, and 14. The lifting apparatus can be shortened by removing extension rails from the rails 2, 4, 12, and 14.

The FIG. 9 shows the left upper rail 2, the left lower rail 4, an upper rail 124 of an extension rail, and a lower rail 126 of the extension rail. As shown, the upper and lower rails 2 and 4 are secured to each other by welding, but other means could be used. As shown, the upper and lower extension rails 124 and 126 are secured to each other by welding, but other means could be used.

A coupling bar 128 is used to couple the lower extension rail 126 to the lower rail 4. The coupling bar 128 has holes 76, the lower rail 4 has holes 122, and the lower rail 126 of the extension rail has holes 130.

When bar 128 and rails 4 and 126 are aligned properly, a shaft 114 of a first bolt can be inserted into holes 130 and 76 to hold the coupling bar 128 to the rail 126, and a shaft 114 of a second bolt can be inserted into holes 122 and 76 to hold the coupling bar 128 to the rail 4. Washers 116 and nuts 118 can be used to hold bolts in place. Nuts and bolts are used in FIG. 9, but other methods can be used to hold coupling bar 128, extension bar, and the rail 4 together, such as rivets or other means.

Also shown in FIG. 9 are holes 72 in upper rail 2, which are used when the pulley assembly 92 is mounted in the upper rail 2. Pulley assembly 92 is shown in FIG. 8. FIG. 9 shows that rotating wheels 108 and 110 are inserted into an interior hollow portion of rail 2, aligned, and then coupled together by a shaft 114 of a bolt. As shown in FIG. 9, the shaft 114 of the bolt is arranged to pass through a center of wheels 108, 110 and also pass through holes 72, and is then secured using a washer 116 and nut 118. Other means can be used to secure the pulley assembly 92 to upper rail 2.

Figure 10:
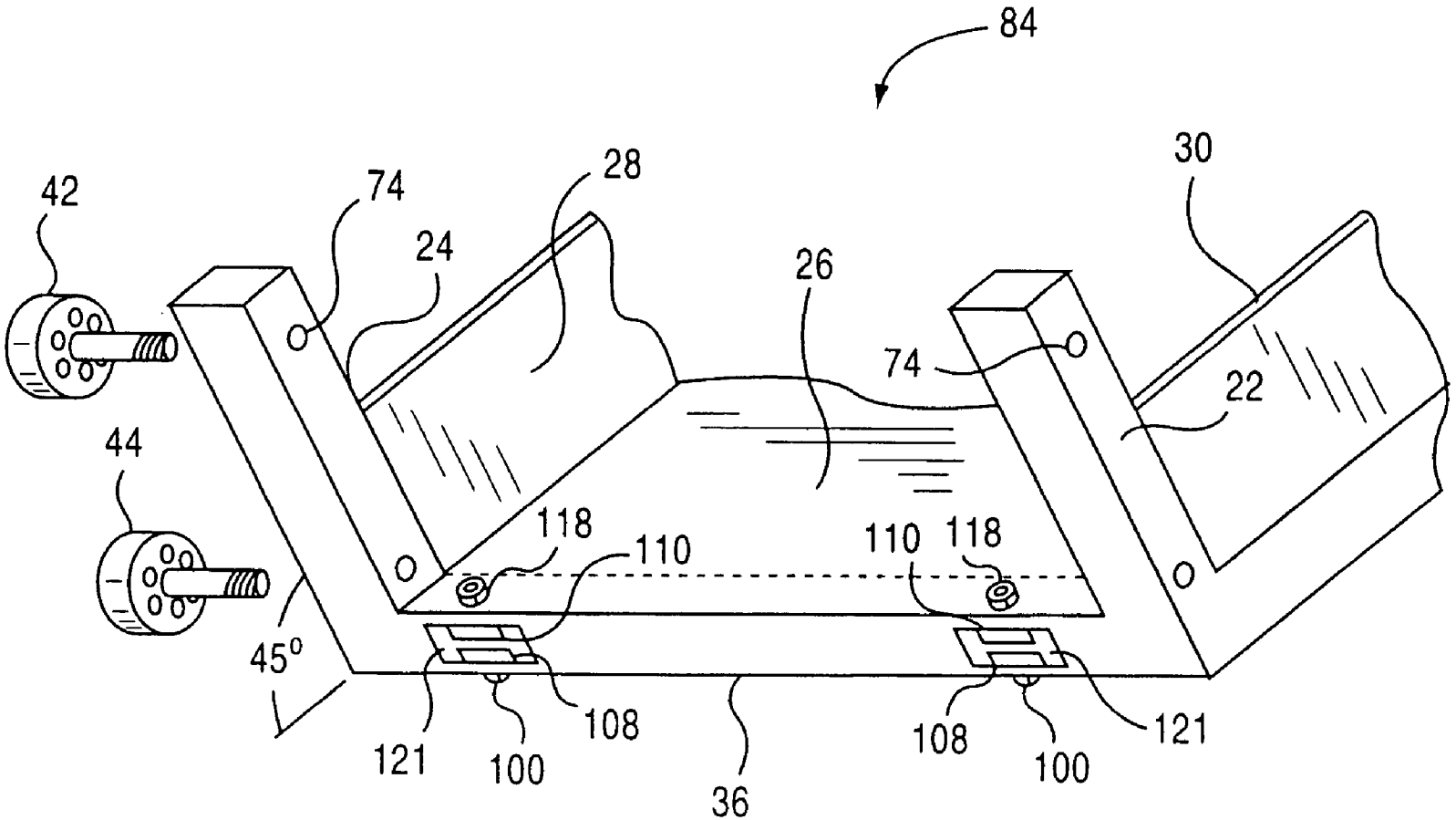
FIG. 10 is a view of one embodiment of a travel platform of a lifting apparatus, in accordance with the principles and features set forth in the subject application, showing pulley assemblies inside a support piece of the travel platform.

FIG. 10 is a view of one embodiment of a travel platform of a lifting apparatus, in accordance with the principles and features set forth in the subject application, showing pulley assemblies inside a support piece of the travel platform. The FIG. 10 shows the rotating wheels 108 and 110 mounted inside the support piece 36 of the travel platform 84. The rotating wheels 108 and 110 are inserted into an interior hollow portion of the support piece 36, aligned, and then coupled together by a shaft 114 of a bolt. As shown in FIG. 10, the shaft 114 of the bolt is arranged to pass through a center of wheels 108, 110 and also pass through holes in the support piece 36, and is then secured using a washer and nut 118. Other means can be used to secure the rotating wheels to the support piece 36. The cable 64 passes through holes 121 in a wall of the support piece 36.

FIG. 11 is a view of pulley assemblies and a path of a cable of one embodiment of a lifting apparatus, in accordance with the principles and features set forth in the subject application, with the cable arranged to have an extra lifting capability and be able to transport an extra heavy weight up and down stairs.

Figure 12:
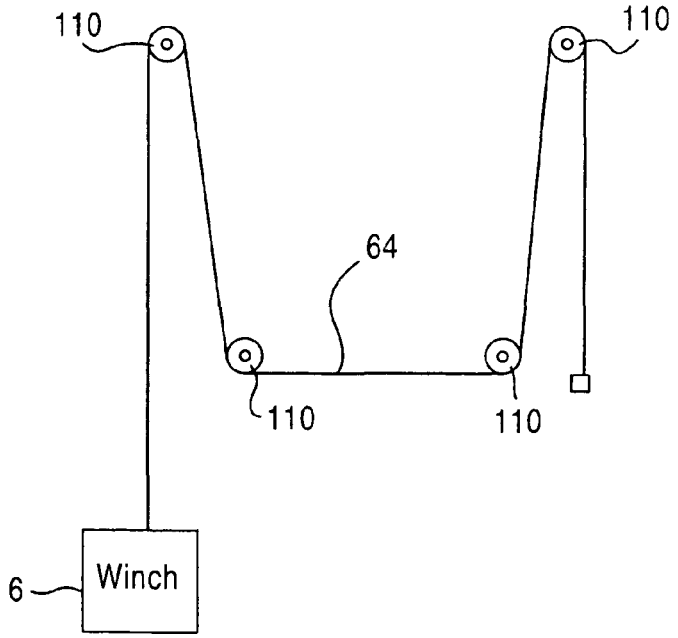
FIG. 12 is a view of pulley assemblies and a path of a cable of one embodiment of a lifting apparatus, in accordance with the principles and features set forth in the subject application, with the cable arranged to have a regular lifting capability and be able to transport a lighter weight up and down stairs.

FIG. 12 is a view of pulley assemblies and a path of a cable of one embodiment of a lifting apparatus, in accordance with the principles and features set forth in the subject application, with the cable arranged to have a regular lifting capability and be able to transport a lighter weight up and down stairs.

Figure 13:
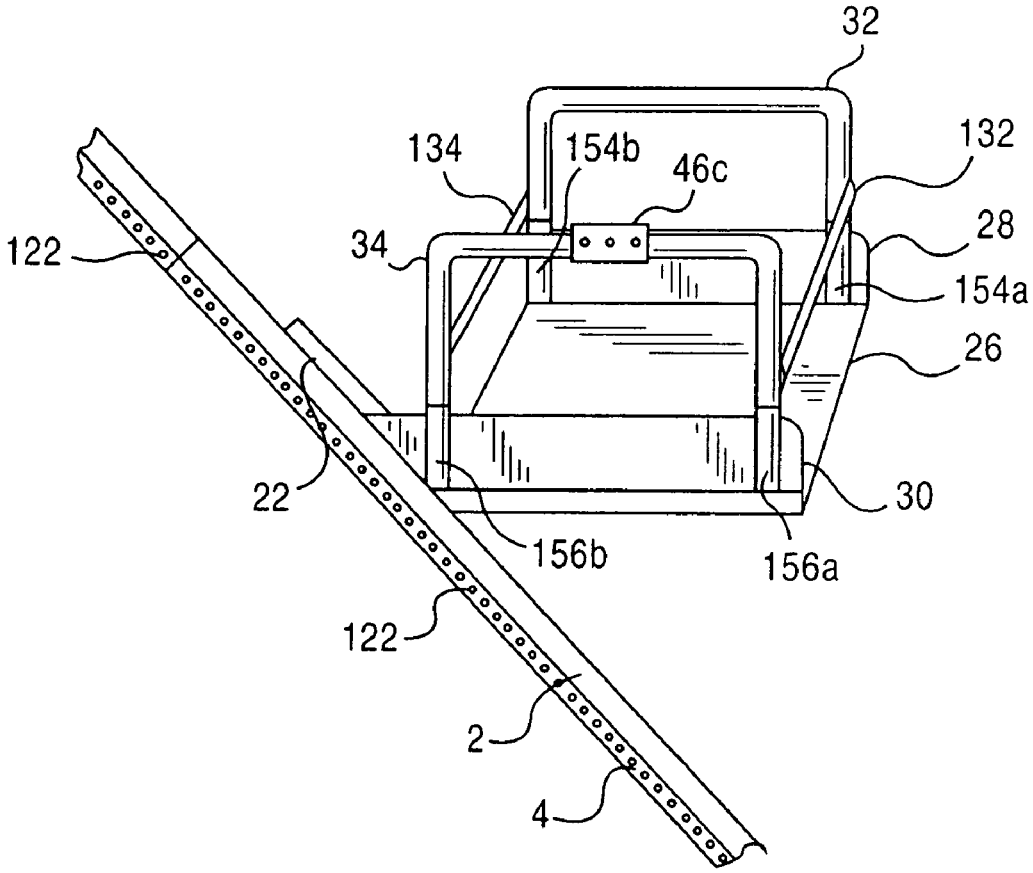
FIG. 13 is a view of one embodiment of a lifting apparatus, in accordance with the principles and features set forth in the subject application, showing safety gates and a control unit on a travel platform.

FIG. 13 is a view of one embodiment of a lifting apparatus, in accordance with the principles and features set forth in the subject application, showing safety gates and a control unit on a travel platform. The FIG. 13 shows lower left rail 4 with holes 122 which can be used in conjunction with extension rails to modify the length of the lifting apparatus. FIG. 13 also shows safety gates 132 and 134 at the sides of the travel platform 84, and a control unit 46*c* on the handrail 34.

The FIG. 13 shows base portion 154*a*, used to mount a bottom of a front side of handrail 32 on the floor portion 26 of the travel platform 84. Base portion 154*b* is similar in configuration to base portion 154*a* and is used to mount a bottom of a rear side of handrail 32. Base portion 156*a* is used to mount a bottom of a front side of handrail 34 on the floor portion 26 of the travel platform 84. Base portion 156*b* is used to mount a bottom of a rear side of handrail 34. These four base portions facilitate the installation and removal of the handrails 32 and 34.

Figures 14A, 14B:
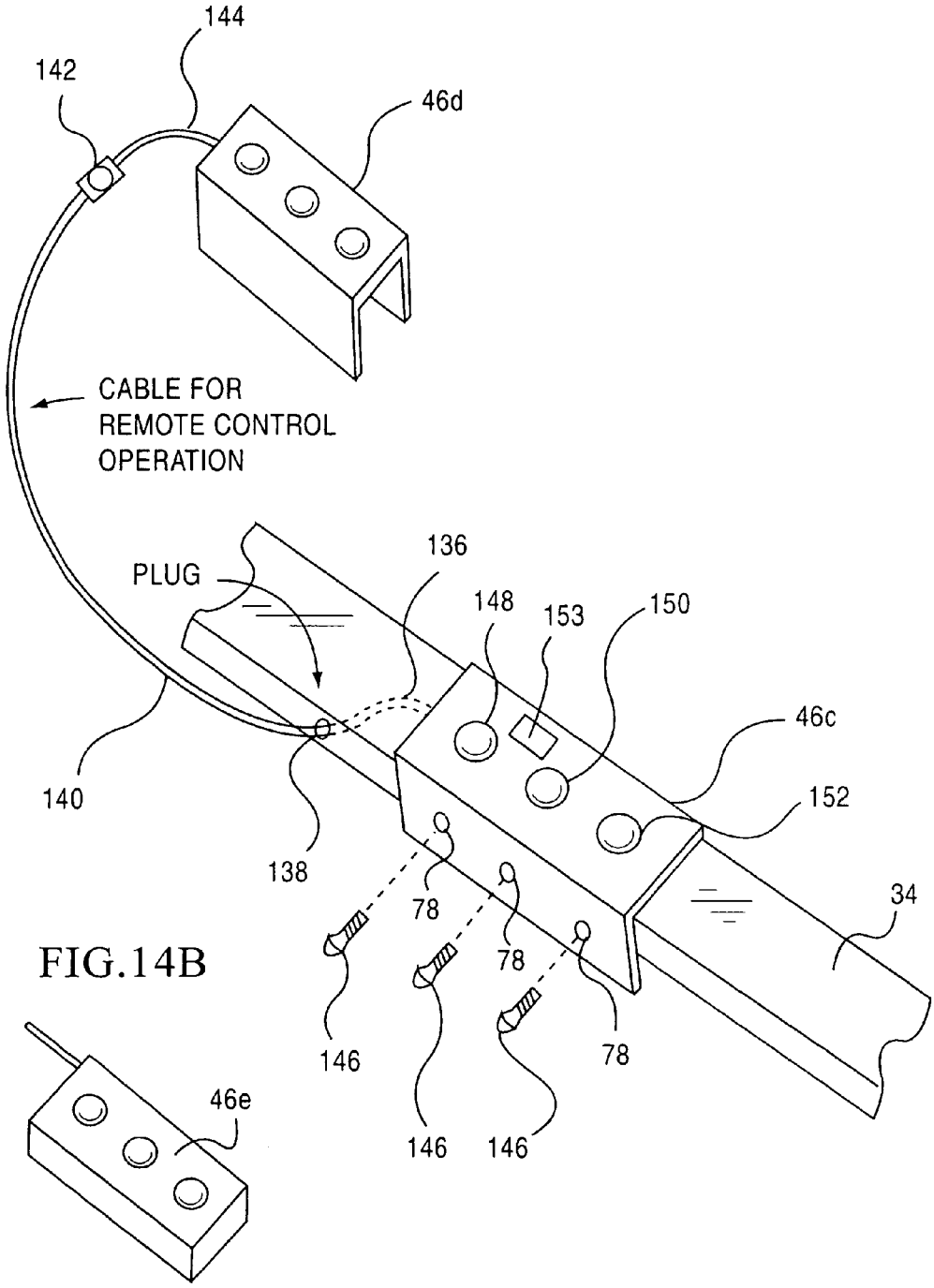
FIG. 14A is a view showing details of control units of one embodiment of a lifting apparatus, in accordance with the principles and features set forth in the subject application.
FIG. 14B is a view showing details of a wireless control unit of one embodiment of a lifting apparatus, in accordance with the principles and features set forth in the subject application.

FIG. 14A is a view showing details of control units of one embodiment of a lifting apparatus, in accordance with the principles and features set forth in the subject application. The FIG. 14A shows control unit 46*d* and control unit 46*c*. Control unit 46*c* is mounted to a handrail 34. The control unit 46*d* can transmit and receive signals through extension cable 140 plugged into handrail 34.

The control unit 46*c* has three control switches: control switch 148, control switch 150; and control switch 152. Additional control switches can be used, and different types of control switches can be used. An operator will press control switch 148 to cause the travel platform 84 to go upwards along a support frame corresponding to rails 2, 4, 12, and 14. The operator will press control switch 152 to cause the travel platform 84 to go downward along the support frame corresponding to rails 2, 4, 12, and 14. The operator will manipulate control switch 150 to control the speed of the travel platform 84.

The control unit 46*c* is secured to the handrail 34 using fasteners 146 and holes 78. Other methods can be used to hold control unit 46*c* to the handrail 34.

The control unit 46*d* has an inverted "U" shape, with a top wall having control switches, two side walls, and an opening instead of a bottom wall. Without fasteners 146, the control unit 46*d* can be held onto the handrail 34 by friction and gravity if the control unit 46*d* is formed to tightly fit over the handrail 34. The control unit 46*d* can be either held in a person's hand and used, or can be placed on the handrail 34 and used.

A communication wire connects the control unit 46*c* to the device 6, so that the control unit 46*c* can be used to instruct device 6 in various ways. For example, control unit 46*c* can output control signals to device 6 through the communication wire, to instruct device 6 to pull in cable 64, to let out cable 64, to speed up, to slow down, to stop, or to do something else.

There are a number of ways to arrange this communication wire that connects control unit 46*c* to device 6. For example, the communication wire can be draped loosely over the side of the travel platform 84, with enough slack so that the travel platform 84 can freely travel up to the top and down to the bottom. The communication wire can be plugged into rail 4 using a plug similar to plug 138. If the communication wire is plugged into a plug in the rail 4, then a wire will be installed in rail 4 which goes from that plug to the device 6.

The speed of the device 6 can be controlled using control unit 46*c*. Thus, the communication wire that connects the control unit 46*c* to the device 6 enables the control unit 46*c* to control the speed of the device 6.

An embodiment of the control unit 46*c* can have an authorization unit 153. The authorization unit 153 allows an authorized user to use the switches 148, 150, and 152 on the control unit 46*c*. The authorization unit 153 is designed to prevent an unauthorized user from using the switches on the control unit 46*c*.

In one embodiment, the authorization unit 153 can be a fairly simple unit, such as a lock which requires a key. If a person does not have the key, then that person would not be able to operate the control buttons and/or switches on the control unit 46*c*, and that person would not be able to operate the lifting apparatus using those controls. However, when an authorized user inserts the key, then the buttons and/or switches would be operable. When everyone is permitted to use the lifting apparatus at a particular location, then the authorization unit 153 can be set to allow everyone to use the lifting apparatus. For example, the key can be simply left in the lock at all times.

In another embodiment, the authorization unit 153 can be a more advanced unit, such as fingerprint sensor detecting a fingerprint of an authorized user, a hand sensor detecting a palm of an authorized user, an eye scanning device detecting the eye of an authorized user, another type of sensor detecting the presence of a card assigned to an authorized user, a radio frequency identification (RFID) system detecting the presence of a device in the possession of an authorized user, or other type of authentication/identification means.

In another embodiment, the authorization unit 153 can have a sensor detecting the presence of a card assigned to an authorized user, can have a memory, and can have other necessary components to verify authorization and/or identification of users. Here, if the lifting apparatus is used at a construction site, a large number of workers can be given cards, with each card having a unique identification number. The memory in the authorization unit 153 can store all of the unique identification numbers corresponding to the cards given to the group of people who will be using the lifting apparatus. Thus, all of those people will be able to use the buttons and/or switches on the control unit 46*c* and will be able to use the lifting apparatus. In the alternative, the authorization unit 153 can be set to be always on in order to allow everyone to use the lifting apparatus at all times.

The control unit 46*d* is a handheld control unit. The control unit 46*d* shown in FIG. 14A is a wired unit. The control unit 46*d* can have buttons and/or switches that are similar to those on the control unit 46*c*. The control unit 46*d* adds to the convenience of the lifting apparatus, because the control unit 46*d* can be held in a right hand or left hand of a person on the travel platform 84.

Also, the control unit 46*d* can be held in the hand of a person walking up the stairs 16 while the travel platform 84 goes up over the stairs 16. This would be very convenient if a large object such as a refrigerator were placed on the travel platform 84.

When the control unit 46*d* is not needed, it can be placed on handrail 34. Also, when the control unit 46*d* is not needed, it can be disconnected from the handrail 34 by unplugging the extension cable 140 at plug 138. The plug 142 can also be used to disconnect control unit 46*d* from handrail 34.

FIG. 14B is a view showing details of a wireless control unit of one embodiment of a lifting apparatus, in accordance with the principles and features set forth in the subject application. As shown in FIG. 14B, the control unit 46*e* is a wireless unit. The control unit can have buttons and/or switches performing functions similar to or identical to the functions performed by the buttons and/or switches on control units 46*c* and 46*d*.

The control unit 46*e* can be a battery-powered unit that uses a first transceiver to wirelessly transmit and receive signals to a second transceiver, wherein the first transceiver is mounted in the control unit 46*e*, and the second transceiver is mounted either on the travel platform 84, near the device 6, in the device 6, or at some other location.

If the second transceiver is mounted to the travel platform 84, then a communication wire can be used to connect the travel platform 84 to the device 6.

Figure 15A:
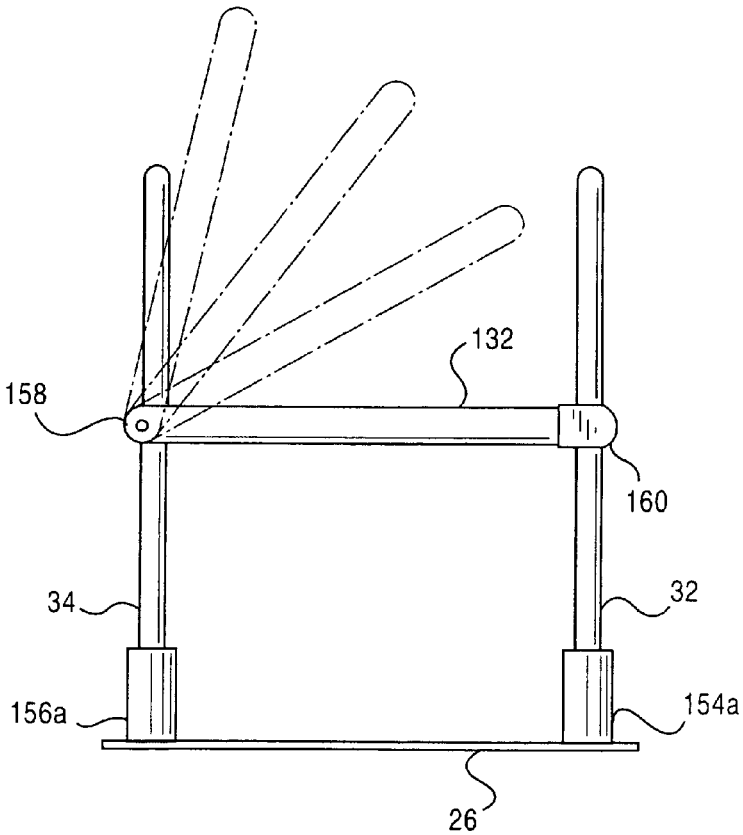
FIG. 15A is a view of one embodiment of a travel platform, in accordance with the principles and features set forth in the subject application, with handrails and a safety gate.

FIG. 15A is a view of one embodiment of a travel platform, in accordance with the principles and features set forth in the subject application, with handrails and a safety gate. The FIG. 15A shows a hinge or pivot 158, a holder 160 for the safety gate 132, and a range of motion of safety gate 132. A base portion 154*a*, used to mount a bottom of a front side of handrail 32, is shown on the floor portion 26 of the travel platform 84. Base portion 154*b* is similar in configuration to base portion 154*a* and is used to mount a bottom of a rear side of handrail 32. The base portion 154*b* is not shown in FIG. 15A, because it is behind the base portion 154*a*. The base portion 154*b* is shown in FIGS. 13 and 16.

Base portion 156*a*, used to mount a bottom of a front side of handrail 34, is shown on the floor portion 26 of the travel platform 84. Base portion 156*b*, used to mount a bottom of a rear side of handrail 34, is behind the base portion 156*a* and is not shown in FIG. 15*a*.

Figure 15B:
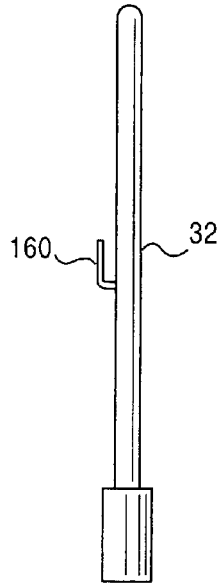
FIG. 15B is a view of a handrail of the travel platform of FIG. 15A, with a holder for a safety gate.

FIG. 15B is a view of a handrail of the travel platform of FIG. 15A, with a holder for a safety gate. The FIG. 15B shows a view of holder 160 and handrail 32 is shown.

Figure 16:
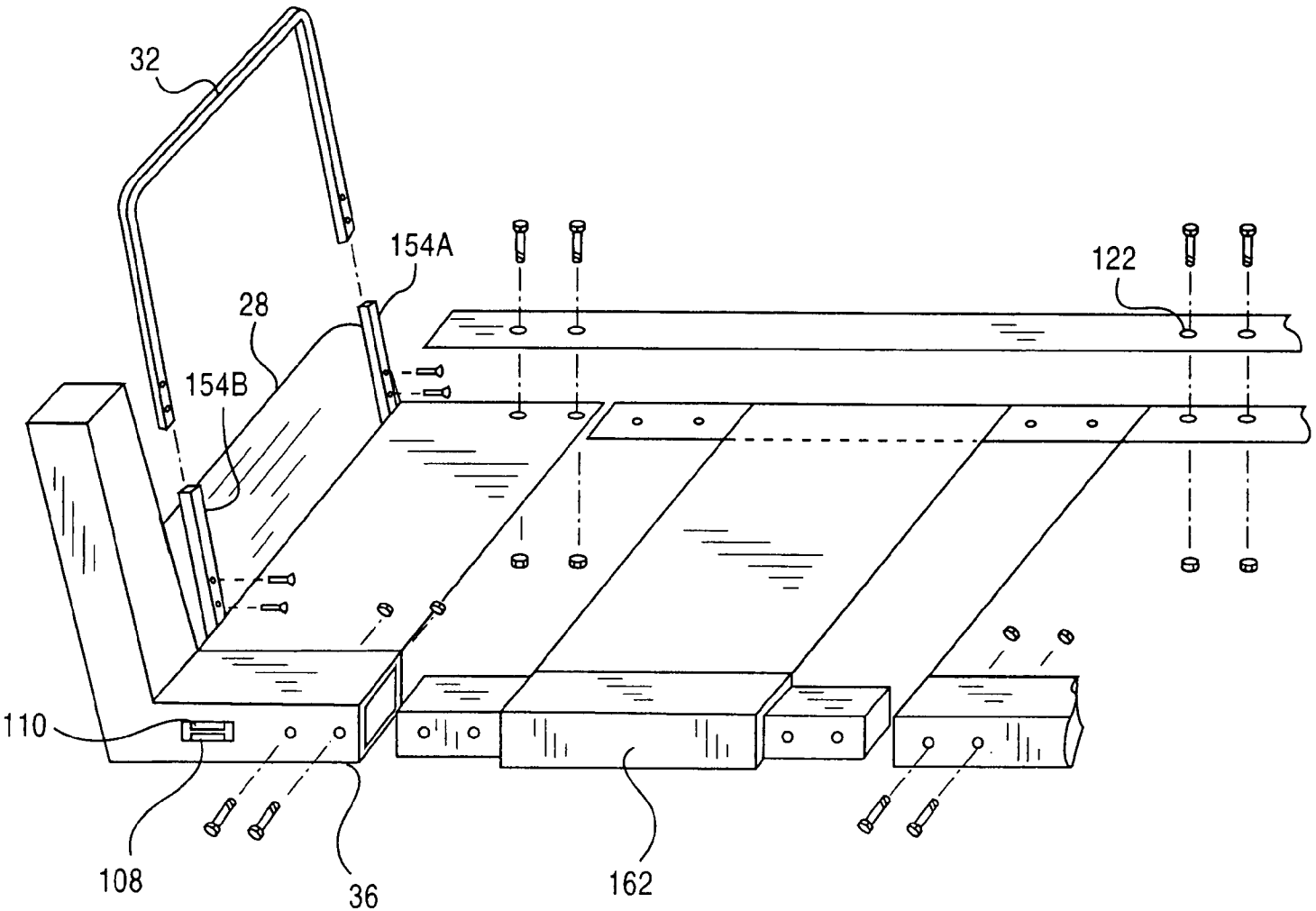
FIG. 16 is a view of one embodiment of a travel platform, in accordance with the principles and features set forth in the subject application, with modular extension components which allow the size of the travel platform to be modified.

FIG. 16 is a view of one embodiment of a travel platform, in accordance with the principles and features set forth in the subject application, with modular extension components which allow the size of the travel platform to be modified. The FIG. 16 shows that a width of the travel platform 84 can be lengthened by adding an extension rod 162 to the support piece 36. One or more coupling bars can be used to secure the extension rod 162 in place. A width of the travel platform 84 can be shortened by removing an extension rod 162 from the support piece 36.

Figure 17:
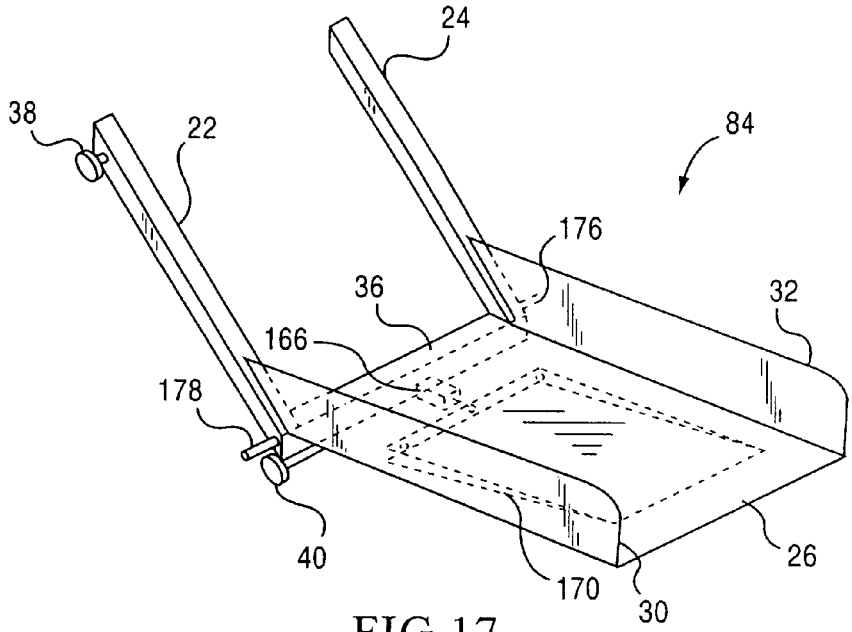
FIG. 17 is a view of one embodiment of a travel platform, in accordance with the principles and features set forth in the subject application, with a safety unit installed under a floor portion of the travel platform.

FIG. 17 is a view of one embodiment of a travel platform, in accordance with the principles and features set forth in the subject application, with a safety unit installed under a floor portion of the travel platform. The FIG. 17 shows a switch 166 and a hinged unit 170 under the floor portion 26 of the travel platform 84. Safety plungers 176 and 178 are also shown.

Figure 18:
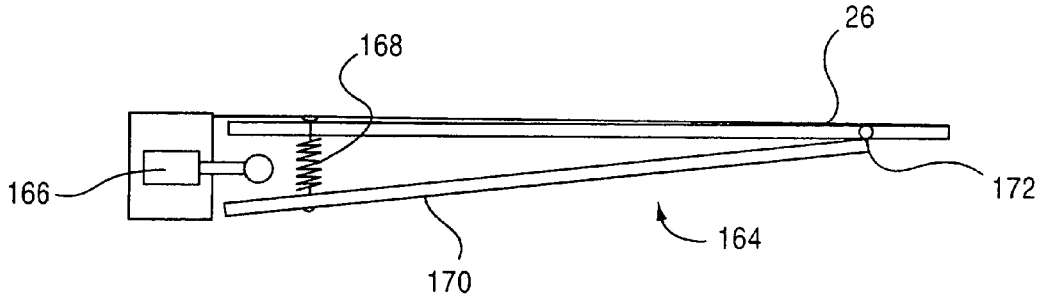
FIG. 18 is a side view of the safety unit of FIG. 17.

FIG. 18 is a side view of the safety unit of FIG. 17. The FIG. 18 shows safety unit 164 which includes switch 166, hinged unit 170, spring 168, and hinge 172. The hinge 172 could be replaced by another type of pivot means. If the travel platform 84 is moving downward, from a second floor to a first floor in a house, for example, a dog might run under the travel platform 84. When the dog is under the travel platform 84, the hinged unit 170 will be pushed upward by the dog's body. When the hinged unit 170 is pushed upward, the spring 168 will be compressed, and the hinged unit 170 will contact the switch 166. When the switch 166 is contacted by the hinged unit 170, a signal will be sent from the switch 166 to the device 6, and the device 6 will stop operating. That is, the device 6 will stop extending the cable 64, and thus the travel platform 84 will stop moving down. This will hold the travel platform 84 in place and thereby prevent and/or minimize injury to the dog.

Figure 19:
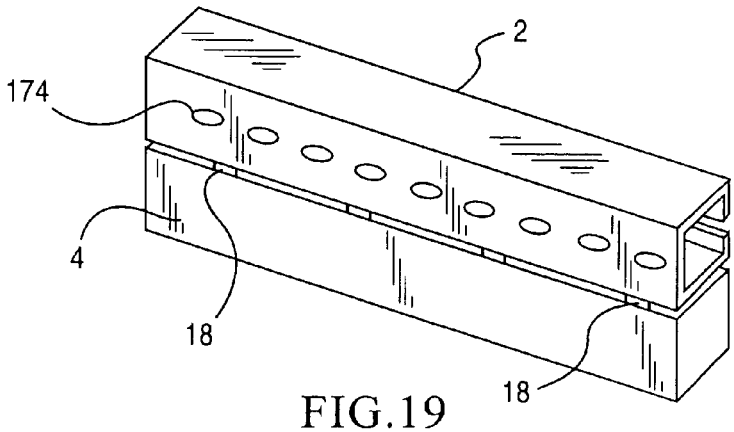
FIG. 19 is a view of a portion of two rails of one embodiment of a lifting apparatus, in accordance with the principles and features set forth in the subject application, with oval holes in a rail which are part of a braking unit.
Figure 30:
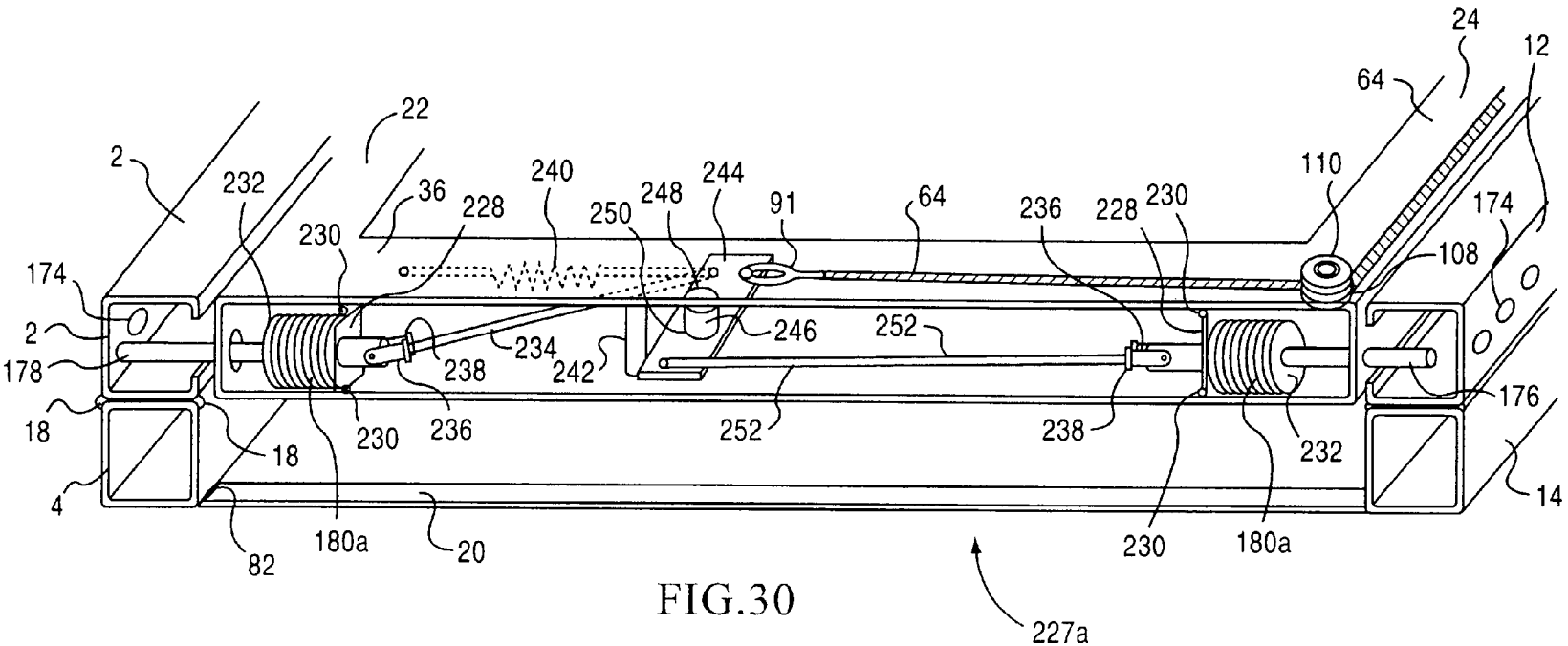
FIG. 30 is a view of portions of a first embodiment of a braking unit of a lifting apparatus, in accordance with the principles and features set forth in the subject application, when a cable of the lifting apparatus has not failed.

FIG. 19 is a view of a portion of two rails of one embodiment of a lifting apparatus, in accordance with the principles and features set forth in the subject application, with oval holes in a rail which are part of a braking unit. The FIG. 19 shows the upper rail 2 forms a plurality of oval-shaped holes 174. If the cable 64 breaks or fails in some manner, a braking unit 227*a* or 227*b* will stop the travel platform 84 from falling. The braking unit 227*a* is shown in FIG. 30, and the braking unit 227*b* is shown in FIG. 32. When the cable 64 fails, safety plunger 178 will be extended outward from the travel platform 84 into a hole 174, and this will stop the travel platform 84 from falling downward.

Figure 20:
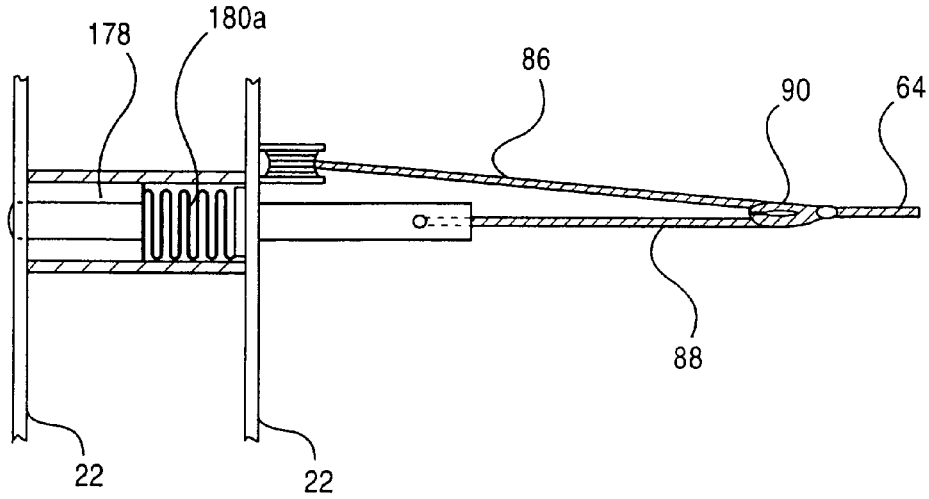
FIG. 20 is a view of portions of a braking unit of one embodiment of a lifting apparatus, in accordance with the principles and features set forth in the subject application, when a cable of the lifting apparatus has not failed.

FIG. 20 is a view of portions of a braking unit of one embodiment of a lifting apparatus, in accordance with the principles and features set forth in the subject application, when a cable of the lifting apparatus has not failed. The FIG. 20 shows the cable 64, a "Y" cable attachment portion 90, a cable portion 86, a cable portion 88, the safety plunger 178, the upright portion 22 on the travel platform 84, and a spring 180*a*. As shown in FIG. 20, the spring 180*a* is in a highly compressed state because the cable 64 has not broken or failed.

Figure 21:
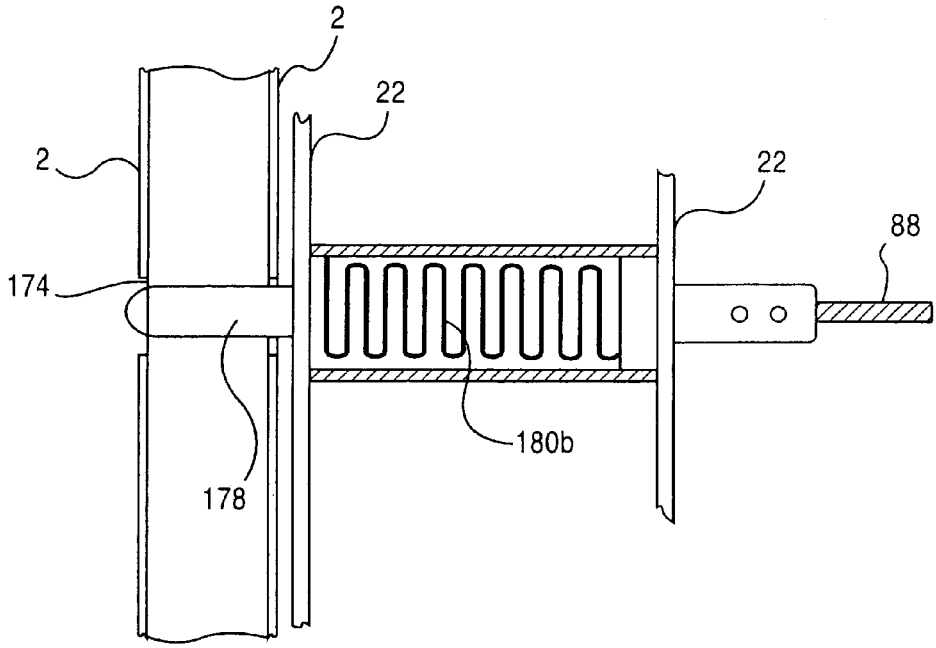
FIG. 21 is a view of portions of the braking unit of FIG. 20, when a cable of the lifting apparatus has failed, and when a safety plunger has extended outward into an oval hole.

FIG. 21 is a view of portions of the braking unit of FIG. 20, when a cable of the lifting apparatus has failed, and when a safety plunger has extended outward into an oval hole. The FIG. 21 shows the cable portion 88, the safety plunger 178, the upright portion 22 on the travel platform 84, the upper rail 2, an oval hole 174 in the rail 2, and a spring 180*b*. As shown in FIG. 21, the spring 180*b* is not in a highly compressed state, because the cable 64 has broken or failed. When the cable 64 fails, the spring 180*b* becomes less compressed, and the safety plunger 178 extends outward into an oval hole 174. The extension of the safety plunger 178 into the oval hole 174 causes the travel platform 84 to stop moving.

Figure 22:
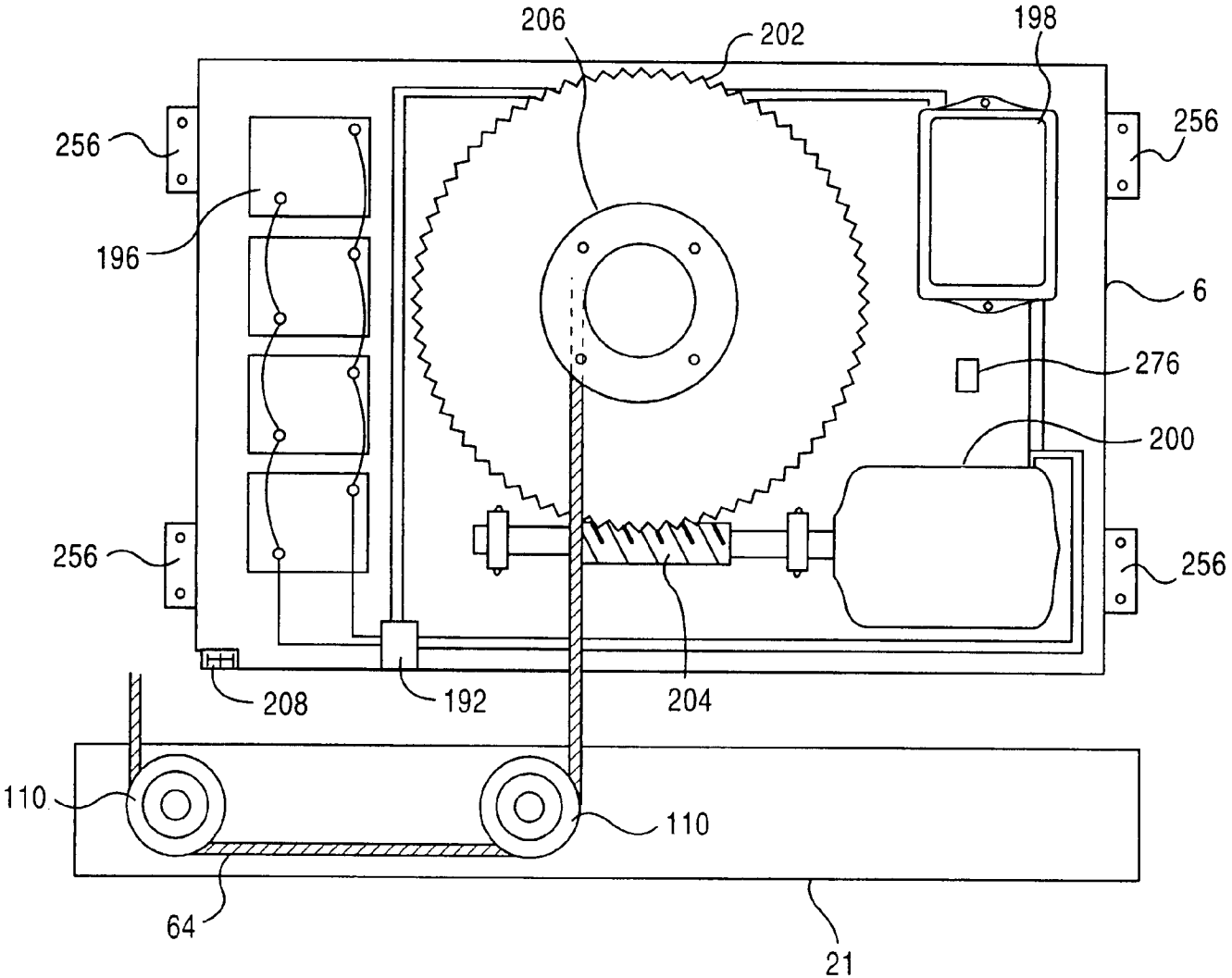
FIG. 22 is a view of a winch and power source of one embodiment of a lifting apparatus, in accordance with the principles and features set forth in the subject application.

FIG. 22 is a view of a winch and power source of one embodiment of a lifting apparatus, in accordance with the principles and features set forth in the subject application. The FIG. 22 shows the winch 6, also known as device 6, with lugs 256, a plug 208, a switch 192, a motor 200, an alternating current/direct current (AC/DC) converter 198, a winch fly wheel 202, a motor gear unit 204 used to drive fly wheel 202, a cable take up reel 206, controller 276, batteries 196, the bar 21, pulley assemblies 110 at the bar 21. The pulley assemblies 110 can be either in or on the bar 21. Another view of the bar 21 is shown in FIG. 29.

The controller 276 controls the operations of many components in the device 6. The controller 276 receives instructions from the control unit 46*c*. For example, when a user presses a button or switch on the control unit 46*c* requesting that the travel platform 84 go up from the first floor to the second floor, the controller 276 in device 6 receives the request. Then the controller 276 controls the motor 200 and other components in device 6 so that the cable 64 is taken in, which causes the travel platform 84 to go up along the rails 2 and 12.

Also, the controller 276 in device 6 has a wireless transceiver, for communicating wirelessly with control unit 46*e*. The AC/DC converter 198 is used to convert between AC and DC. The motor 200 can be a 12 volt motor. The motor 200 is used to drive components such as 202, 204, and 206, which are needed to retract or take in the cable 64, and are needed to extend or let out the cable 64. The motor 200 can be any means of driving components needed to take in or let out the cable 64.

The batteries 196 can be rechargeable 12 volt batteries. An AC external power source can be plugged into the plug 208. The switch 192 allows a user to switch from the AC external power source to the internal battery power source. The batteries 196 can be recharged when the AC external power source is connected through plug 208. The batteries 196 can be replaced by any other means of power supply. For example, batteries 196 can be replaced by fuel cells or other types of power sources.

The device 6 can be plugged into a cigarette lighter in an automobile 278, and the lifting apparatus can be operated using the power received from that cigarette lighter. The device 6 can be connected to an automobile battery, and the lifting apparatus can be operated using the power received from that automobile battery.

The device 6 can have a double line capacity of 440 lbs., can have a single line capacity of 220 lbs., can operate either on AC or DC, can deliver a line speed of 30 feet per minute, can have an automatic cut off switch, can contain 40 feet of cable, and can weigh 30 lbs. The device 6 is not limited to these features, though. Alternative winches and/or devices can be used to pull in cable 64 and let out cable 64 to move the travel platform 84 up and down. One or more of the lugs 256 can be used to mount the device 6 to one or more of the rails 2, 4, 12, and/or 14.

Figure 23:
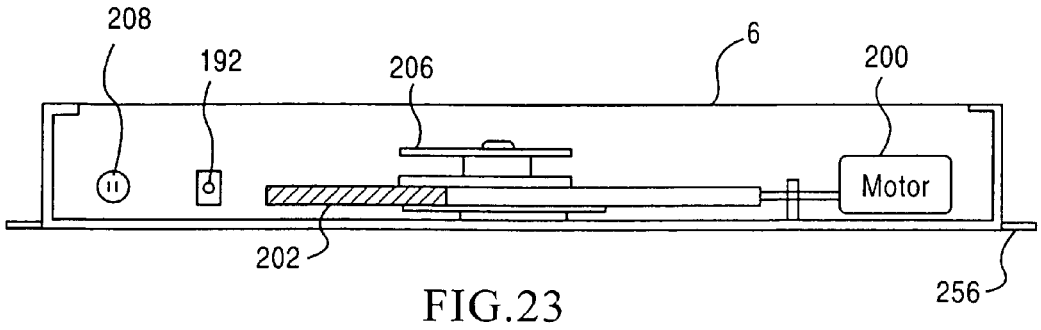
FIG. 23 is a side view of the winch and power source shown in FIG. 22.

FIG. 23 is a side view of the winch and power source shown in FIG. 22. The FIG. 23 shows features of device 6, in a manner that demonstrates that the device 6 can have a low profile and a small size.

FIG. 24 is a side view of one embodiment of a lifting apparatus, in accordance with the principles and features set forth in the subject application, with oval holes in a rail. The FIG. 24 shows a pivoting foot 182 for the bottom of rail 4, and a rubber cushion 194 on the bottom of the foot 182. The foot 182 can also be installed on the bottom of rail 14. The oval holes 174 are shown in rail 2, to be used in conjunction with the safety plunger 178 and a braking unit 227*a*, 227*b*.

Figure 25:
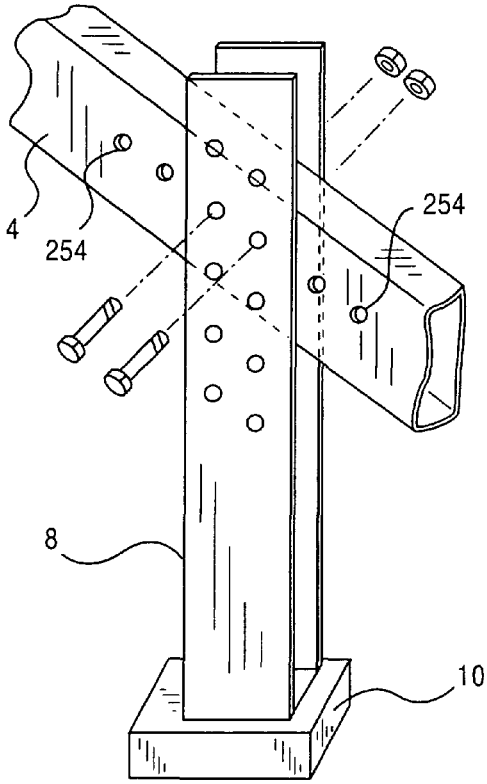
FIG. 25 is a view of aspects of a first type of leg and foot of one embodiment of a lifting apparatus, in accordance with the principles and features set forth in the subject application.

FIG. 25 is a view of aspects of a first type of leg and foot of one embodiment of a lifting apparatus, in accordance with the principles and features set forth in the subject application. The FIG. 25 shows the leg 8 is attached to rail 4 near the top of the lifting apparatus. Because of a plurality of holes 254 in rail 4 near the top of the lifting apparatus, the placement of the leg 8 can be adjusted, so that the lifting apparatus can be used at staircases having different sizes. Rail 14, not shown in FIG. 25, also has holes near the top of the lifting apparatus, for the placement of a second leg 8. The foot 10 can be a rubber cushion which helps to prevent any damage to the floor surface under the lifting apparatus.

Figure 26A:
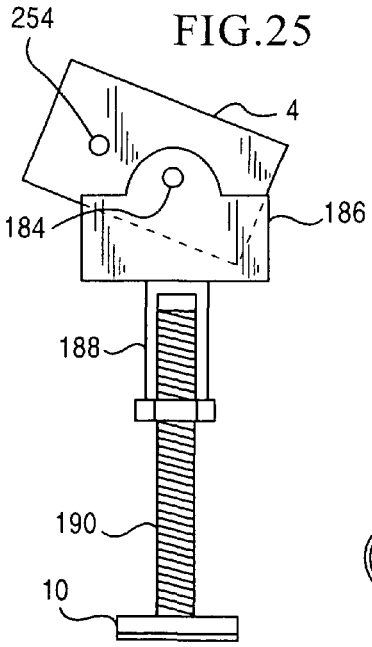
FIG. 26A is a view of aspects of a second type of leg and foot of one embodiment of a lifting apparatus, in accordance with the principles and features set forth in the subject application.

FIG. 26A is a view of aspects of a second type of leg and foot of one embodiment of a lifting apparatus, in accordance with the principles and features set forth in the subject application. The FIG. 26A shows that there is a pivot 184, a pivot portion 186, a threaded cylinder 188, a threaded shaft 190, and a foot 10.

Figure 26B:
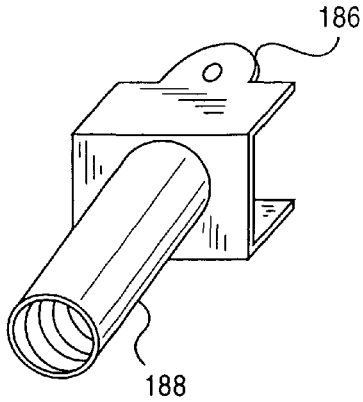
FIG. 26B is a view of some aspects of the leg of FIG. 26A.

FIG. 26B is a view of some aspects of the leg of FIG. 26A. The FIG. 26B shows the pivot portion 186, and also the threaded cylinder 188.

Figure 26C:
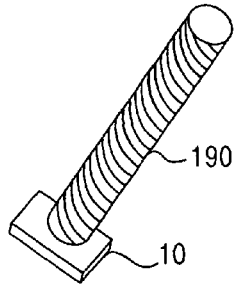
FIG. 26C is a view of some aspects of the leg of FIG. 26A.

FIG. 26C is a view of some aspects of the leg of FIG. 26A. The FIG. 26C shows a threaded cylinder 190 and foot 10. Other types of legs/feet or support devices could be used, in place of the legs and feet depicted in FIGS. 25 through 26C.

Figure 27:
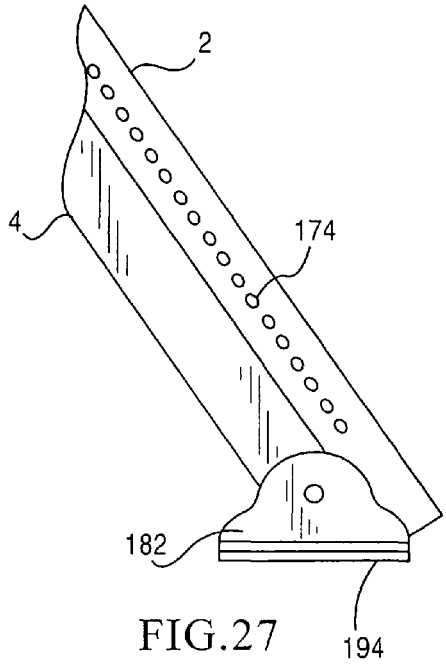
FIG. 27 is a view of aspects of a foot of one embodiment of a lifting apparatus, in accordance with the principles and features set forth in the subject application.

FIG. 27 is a view of aspects of a foot of one embodiment of a lifting apparatus, in accordance with the principles and features set forth in the subject application. As shown in FIG. 27, the pivoting foot 182 is mounted at the bottom of the rails 4 and 14. The rubber cushion 194 is on the bottom of foot 182, to prevent any damage to the floor surface under the lifting apparatus.

Figure 28:
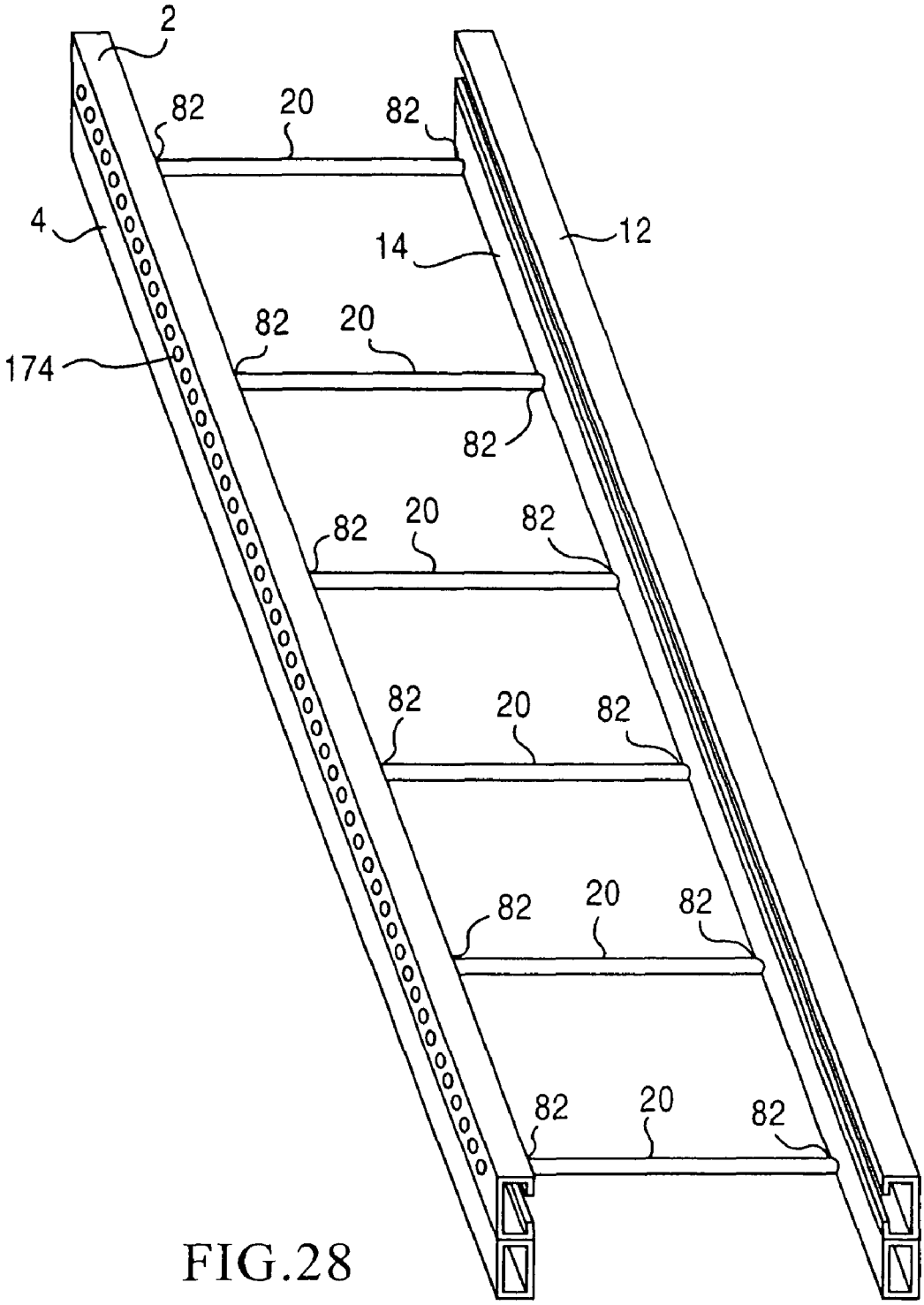
FIG. 28 is a view of portions of one embodiment of a lifting apparatus, in accordance with the principles and features set forth in the subject application, showing cross-bars between rails.

FIG. 28 is a view of portions of one embodiment of a lifting apparatus, in accordance with the principles and features set forth in the subject application, showing cross-bars between rails. As shown in FIG. 28, the cross-bars 20 help to keep the rails 2, 4, 12, and 14 substantially parallel to each other, and help to form a rigid, strong support frame for the lifting apparatus.

FIG. 29 is a view of one embodiment of a lifting apparatus, in accordance with the principles and features set forth in the subject application, with a foldable travel platform in a standard position. As shown in FIG. 29, there is depicted the foldable travel platform 84 in a standard position for transporting people, wheelchairs, and/or other objects. The standard position of the foldable travel platform 84 can also be referred to as a substantially horizontal position. That is the position of the travel platform 84 when it is used to transport people, wheelchairs, and/or other objects.

Figure 33:
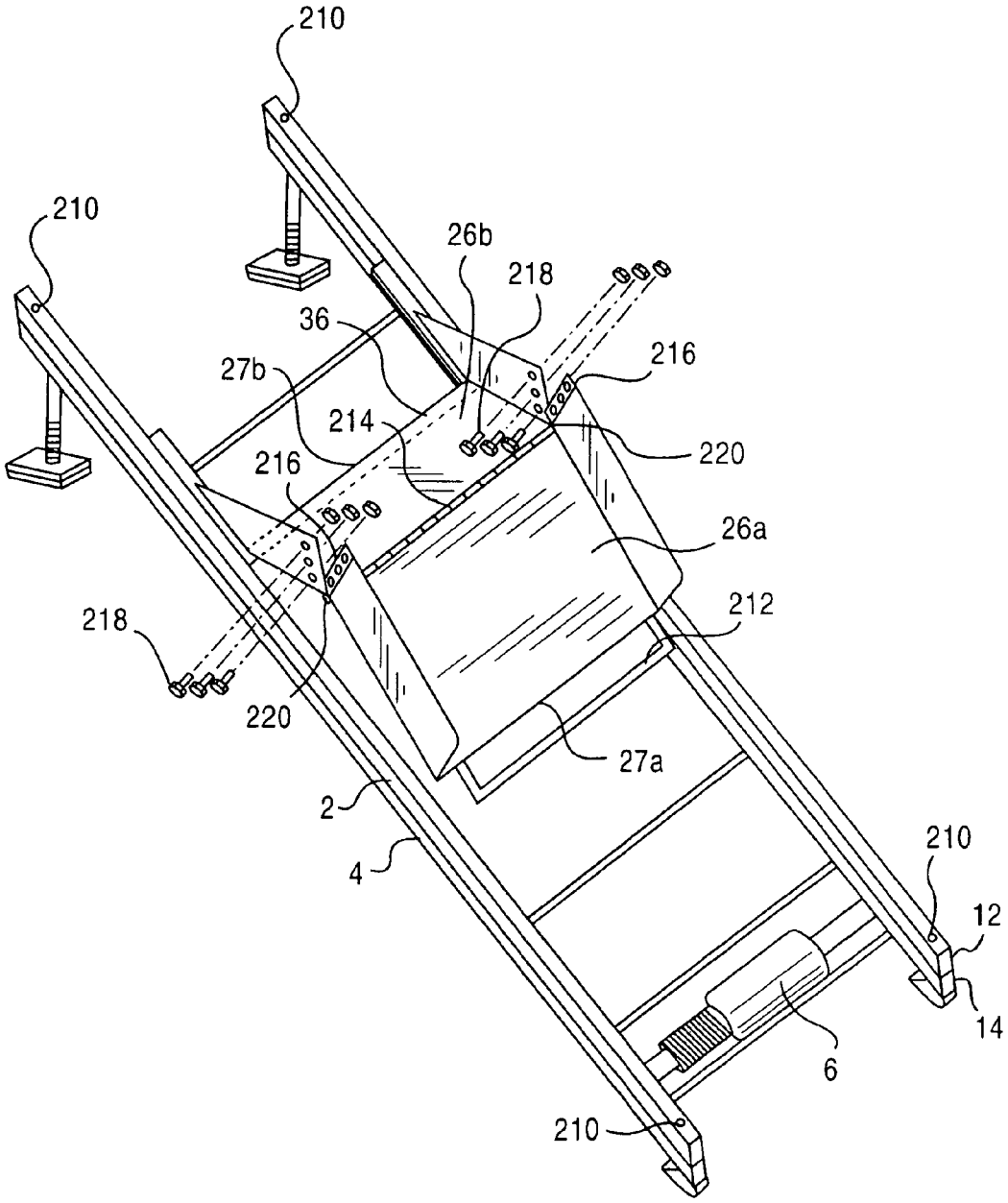
FIG. 33 is a view of one embodiment of a lifting apparatus, in accordance with the principles and features set forth in the subject application, with a foldable travel platform in a low-profile position, with a locking handle in the unlocked position.
Figure 34:
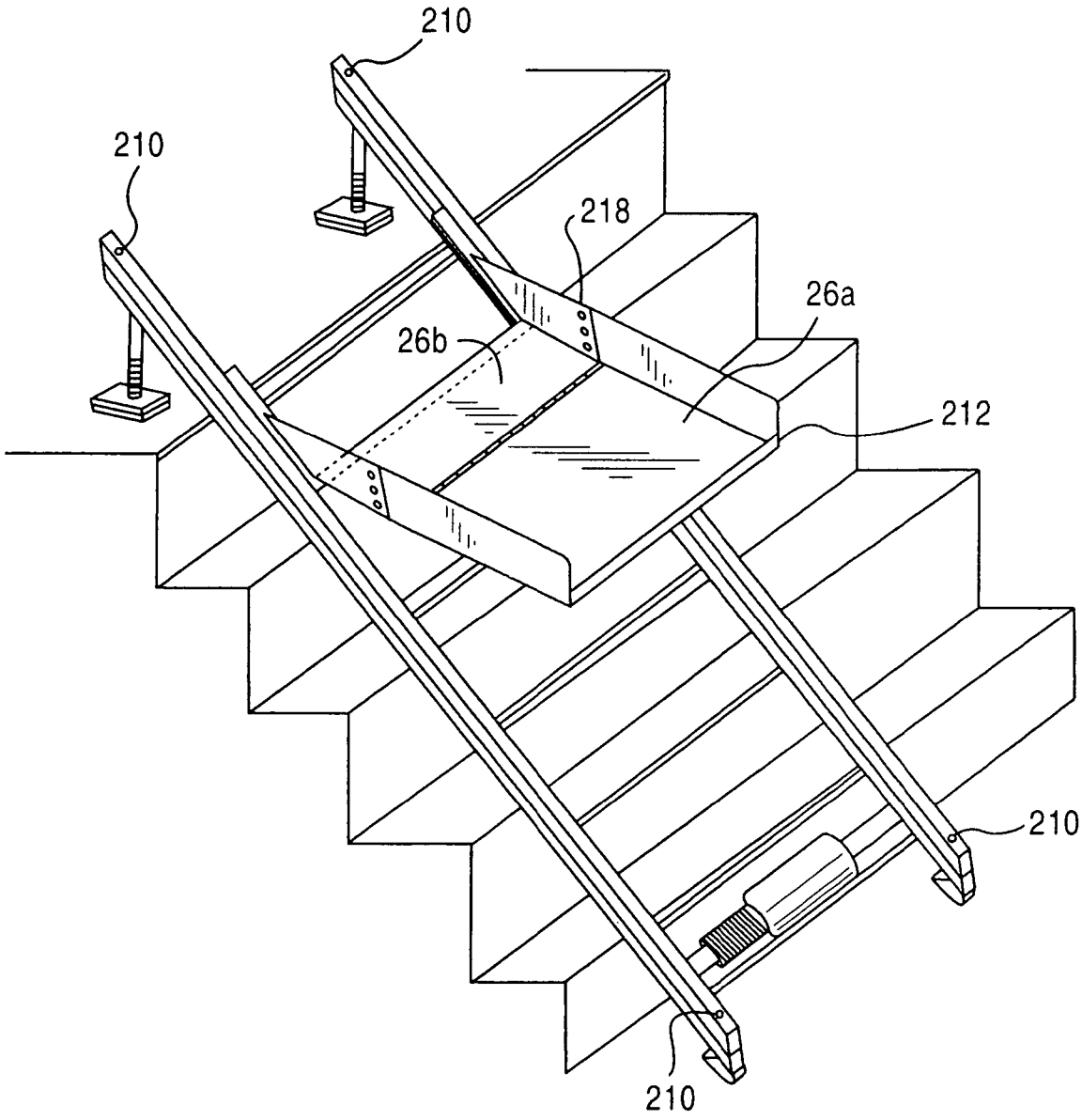
FIG. 34 is a view of the lifting apparatus of FIG. 33, with the foldable travel platform in the standard position for transporting people and/or objects, with the locking handle in the locked position.
Figure 36A:
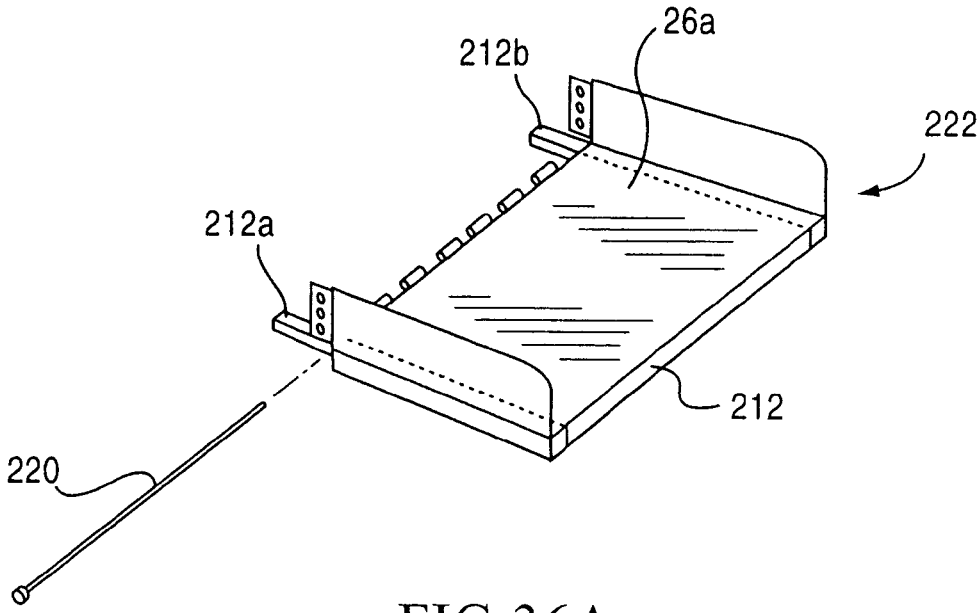
FIG. 36A is a view of portions of a regular-sized foldable travel platform of one embodiment of a lifting apparatus, in accordance with the principles and features set forth in the subject application.
Figure 36B:
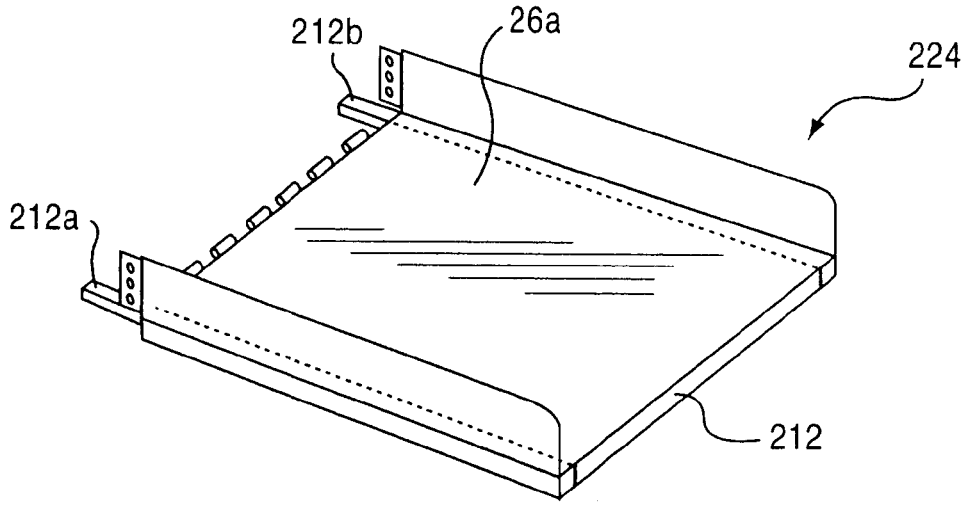
FIG. 36B is a view of portions of a large-sized foldable travel platform of one embodiment of a lifting apparatus, in accordance with the principles and features set forth in the subject application.
Figure 37:
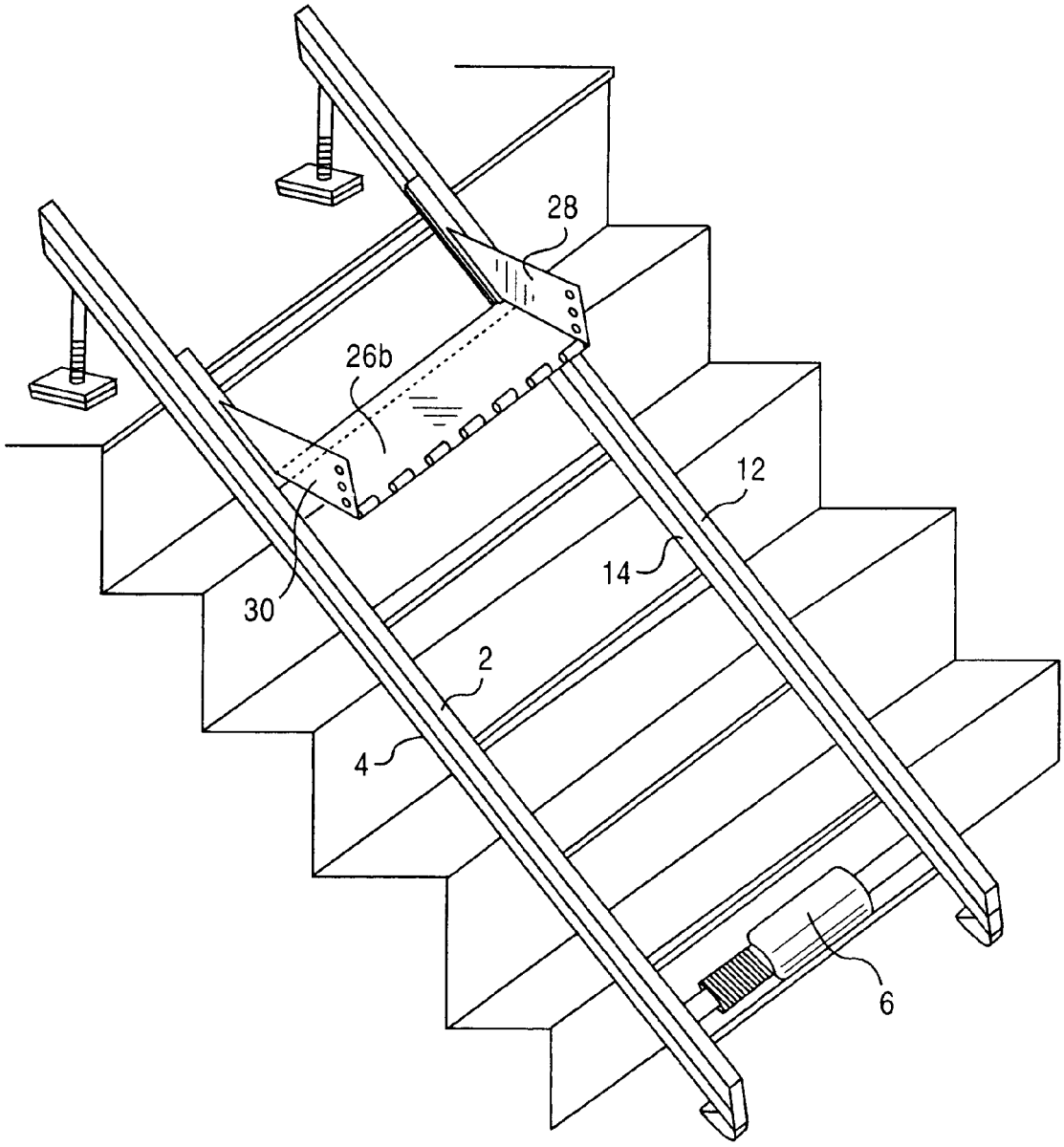
FIG. 37 is a view of the lifting apparatus of FIG. 33, with portions of the foldable travel platform removed.

The foldable travel platform 84 can be in a standard position as depicted in FIGS. 29 and 34, or can be in a low-profile position as depicted in FIG. 33. Also, portions of the foldable travel platform 84 can be disassembled. FIGS. 36A, 36B, and 37 show disassembled portions of the foldable travel platform 84. The foldable travel platform 84 makes it easier to transport the lifting apparatus from one staircase to another staircase, from one structure 280 to another structure 282, from one building to another building, and from one house to another house, for example.

The FIG. 29 shows the cable 64 arranged inside rail 2, and with support brackets 211 helping to hold the foldable travel platform 84 in the standard position. The support brackets 211 can be removed when it is desired to put the travel platform 84 in the low-profile position. The low-profile position of the foldable travel platform 84 is depicted in FIG. 33, for example.

One support bracket 211 has a first end connected to upright portion 22 by a fastener such as a screw or nut/bolt combination or other means, and has a second end connected to side wall 30 by a fastener. The other support bracket 211 has a first end connected to upright portion 24 by a fastener, and has a second end connected to side wall 28 by a fastener. The support brackets 211 can be attached or removed whenever necessary.

As depicted in FIG. 29, the cable 64 travels along a path from device 6 to a wheel 110 inside the bar 21, then travels inside the bar 21 toward rail 2, then travels to a wheel 110 inside a lower region of rail 2, and then travels inside rail 2 up to a wheel 110 at an upper region of rail 2. Then the cable 64 travels outside rail 2 to a first wheel 110 inside the support piece 36 of the travel platform 84, then through the inside of the support piece 36. The cable 64 then travels to a second wheel 110 inside support piece 36, then travels up to a wheel 110 at an upper region of rail 12. Then the cable 64 travels down to the braking unit **227*b* at the travel platform 84. Details of the braking unit 227*b* are shown in FIG. 32**.

FIG. 30 is a view of portions of a first embodiment of a braking unit of a lifting apparatus, in accordance with the principles and features set forth in the subject application, when a cable of the lifting apparatus has not failed. The FIG. 30 depicts braking unit **227*a*, rail 2, rail 4, rail 12, rail 14, cross bar 20, springs 180*a*, holes 174, welds 18 and 82, safety plungers 176 and 178, spring pull lock 232, cable attachment portion 91, cable 64, rotating wheels 108 and 110, upright portions 22 and 24, support piece 36, spring stop plates 228, spring stop plate welds 230, left side safety plunger connection rod 234, safety plunger connection rod adjustable connection 236, lock nut safety plunger adjustable connection rod 238, safety plunger tension spring 240, safety plunger lever stop 242, safety plunger control unit arm 244, safety plunger control unit mount 246, safety plunger control unit bolt 248, safety plunger weld 250, and connect rod control unit to safety plunger 252**.

The braking unit **227*a* depicted in FIG. 30 is the first embodiment of a braking unit of the lifting apparatus of FIG. 1. As shown in FIG. 30, the cable 64 has not yet failed. As shown in FIG. 30, the cable 64 has a predetermined amount of tension. Thus, cable 64 is pulling the safety plunger control unit arm 244 in a first direction, and the safety plunger tension spring 240 is pulling the safety plunger control unit arm 244** to a second direction which is opposite to the first direction.

If the cable 64 breaks or otherwise fails, then the cable 64 would have an amount of tension that is less than the predetermined amount of tension. When the cable 64 breaks or fails, then the cable 64 is no longer pulling the safety plunger control unit arm 244 in the first direction. As a result, the safety plunger tension spring 240 pulls the safety plunger control unit arm 244 further over toward the second direction, which causes: the safety plunger control unit arm 244 to rotate around the safety plunger control unit mount 246; the safety plunger 176 to extend into a hole 174 formed in the rail 12 to stop movement of the travel platform 84; and the safety plunger 178 to extend into a hole 174 formed in the rail 2 to stop movement of the travel platform 84.

The plate 244 is made so that it swivels at the center 248 and has a stop 242 which allows the plate unit to travel or be pulled in a forward movement. A cable or rod 234 is attached to the plunger unit at its end and the other end is attached to the movable plate 244. When the cable has tension on it the cable will pull the plate in the direction of the pull causing the plate unit to pull the plunger 178 back, in addition as the plate unit is being pulled forward there is another rod attached to the plunger unit 176 on the right side of the platform causing the plunger to be pulled back. There is a spring 240 affixed to the plate unit to pull the plate unit in the opposite direction. If the cable 64 were to break or the cable became slack, this would allow for the plungers to be extended into the holes 174 on each of the track units.

Each of the plunger units have springs **180*a*. When there is no pull pressure on the cable, the springs then drive the plungers into the holes on each of the rail units. The rod or cable attachments 234 has an adjustable connection 236 and a lock nut 238 to secure the correct adjustment of the plunger unit so as to allow the plungers to be inside of track 2 and 12 but only ⅜ inch or so from going into the holes 174** on each of the track units, which will result in the platform unit being stopped promptly.

Figure 31:
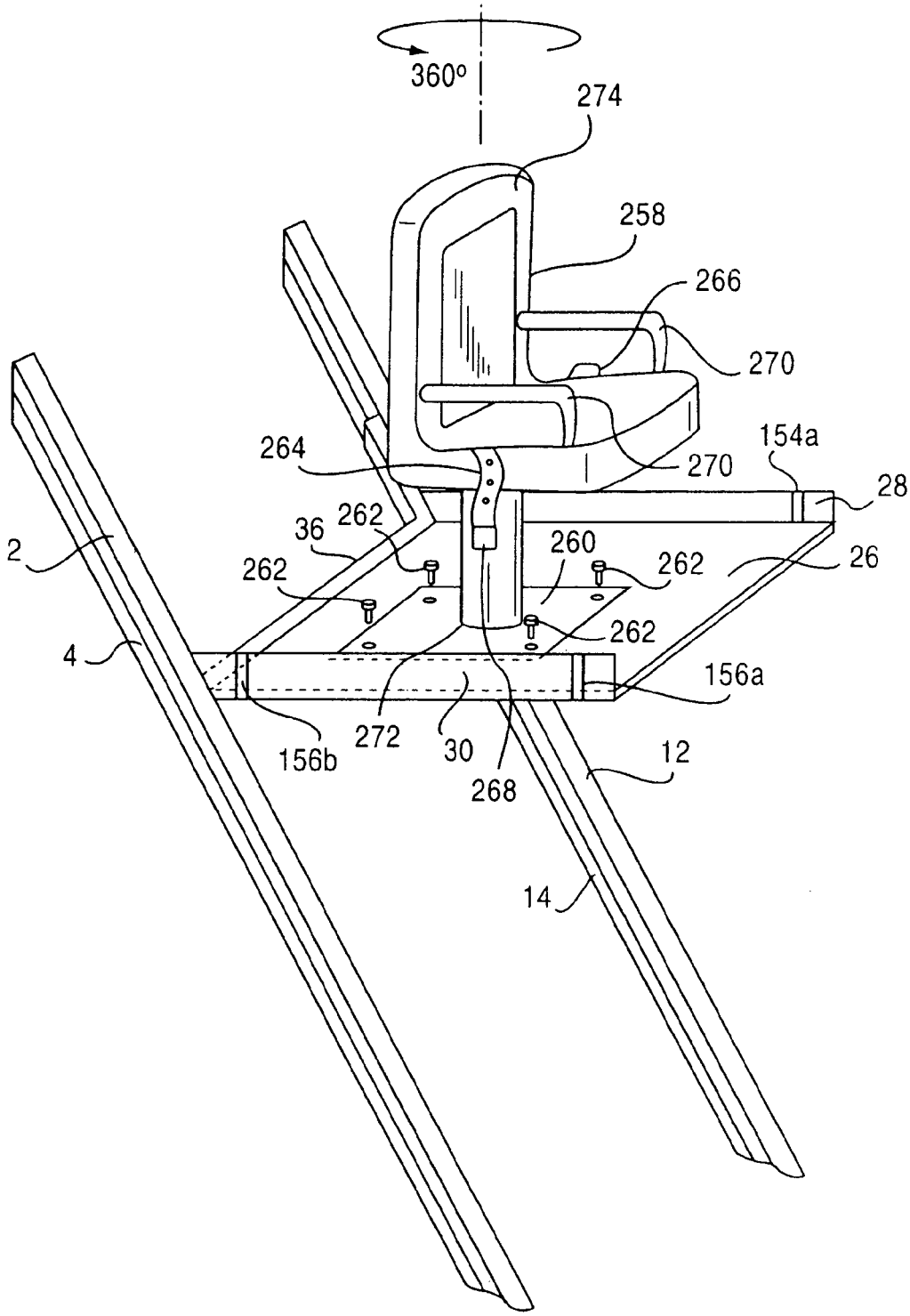
FIG. 31 is a view of a travel platform of one embodiment of a lifting apparatus, in accordance with the principles and features set forth in the subject application, with a seat mounted on the travel platform.

FIG. 31 is a view of a travel platform of one embodiment of a lifting apparatus, in accordance with the principles and features set forth in the subject application, with a seat mounted on the travel platform. The FIG. 31 shows the rails 2, 4, 12, 14, the floor portion 26 of the travel platform 84, the support piece 36, the side walls 28, 30, and the base portions **154*a*, 156*a*, 156*b*. An optional seat unit 258 is shown mounted to the floor portion 26. The seat unit 258 can rotate 360°. FIG. 31 shows a mount 260 for the seat unit 258, screws 262, seat belt 264, seat belt lock device 266, seat belt buckle 268, seat unit hand rails 270, weld 272 at seat support, and back support 274. At a first floor or level, a person can step onto the travel platform 84, sit down in the seat unit 258, ride the travel platform 84 to a different floor or level, then swivel the chair around and step off the travel platform 84**.

FIG. 32 is a view of portions of a second embodiment of a braking unit of a lifting apparatus, in accordance with the principles and features set forth in the subject application, when a cable of the lifting apparatus has not failed. The FIG. 32 depicts braking unit **227*b*, rail 2, rail 4, rail 12, rail 14, cross bar 20, springs 180*a*, holes 174, welds 18 and 82, safety plungers 176 and 178, spring pull lock 232, "Y" cable attachment portion 90, cable 64, rotating wheels 108 and 110, upright portions 22 and 24, support piece 36, spring stop plates 228, spring stop plate welds 230, bolt head 100, washers 102, 116, nut 118, bolt shaft 114, and end 120** of bolt shaft.

One end of the cable 64 is converted to actually have two terminating portions, because of the "Y" cable attachment portion 90 shown in FIG. 32. Each one of these two cable terminating portions is arranged to pass around wheels rotatable around shaft 114 as shown in FIG. 32. Also, each one of these two cable terminating portions is connected directly to a safety plunger, as shown in FIG. 32.

The braking unit **227*b* depicted in FIG. 32 is the second embodiment of a braking unit of the lifting apparatus of FIG. 1. As shown in FIG. 32, the cable 64 has not yet failed. As shown in FIG. 32, the cable 64 has a predetermined amount of tension. Thus, cable 64 is pulling the safety plungers 176 and 178 and causing the springs 180*a*** to be in a highly compressed state.

If the cable 64 breaks or otherwise fails, then the cable 64 would have an amount of tension that is less than the predetermined amount of tension. When the cable 64 breaks or fails, then the cable 64 is no longer pulling the safety plungers 176 and 178 and causing the springs 180*a* to be in a highly compressed state. As a result, the springs 180*a* would be in a less compressed state, the safety plunger 176 would extend into a hole 174 formed in the rail 12 to stop movement of the travel platform 84, and the safety plunger 178 would extend into a hole 174 formed in the rail 2 to stop movement of the travel platform 84.

A tension sensor 233 is an optional component, shown in FIG. 32. The tension sensor 233 is not required. The tension sensor can be implemented in a variety of different ways.

A first way to implement the tension sensor 233 is as follows. The tension sensor 233 is placed directly in the path of the cable 64, and thus would sense changes in tension of the cable 64 directly. One side of the tension sensor 233 can be connected to one end of cable 64, as shown in FIG. 32, and then another side of the tension sensor 233 can be connected to the cable portion that has the "Y" cable attachment portion 90. When there is a change in the tension of cable 64, and that change is larger than a predetermined amount, then the sensor 233 causes one or more safety plungers to extend outward into oval holes 174. The tension sensor 233 detects either a slight change or a large change in the tension of cable 64, depending on how the tension sensor 233 is calibrated or set. Thus, when the tension sensor 233 is implemented, if something occurs which causes a change in the tension of the cable 64, even if the cable 64 does not break, one or both safety plungers 176, 178 will extend and stop movement of the travel platform 84.

For example, while the travel platform 84 is moving upward, if an object slips partly off the travel platform and then is resting on one of the stairs, there would be a distinguishable change in the tension of cable 64. The cable 64 has not broken or failed, but there clearly is a change in the tension of cable 64. The sensor 233 will detect this change in the tension, and then will automatically cause one or more safety plungers 176, 178 to extend outward into oval holes 174.

The tension sensor 233 could automatically cause one or more safety plungers 176, 178 to extend outward into oval holes 174 in a variety of different ways. For example, the tension sensor 233 could completely release the cable portion that has the "Y" cable attachment portion 90, thus simulating a break in the cable 64. Or the tension sensor 233 could merely allow the cable portion that has the "Y" cable attachment portion to move enough to simulate a failure of cable 64, without completely releasing the cable portion that has the "Y" cable attachment portion.

If the tension sensor 233 is placed as shown in FIG. 32, then the tension sensor 233 will cause both safety plungers 176, 178 to extend outward into oval holes 174.

A second way to implement the tension sensor 233 is as follows. The tension sensor 233 is not placed directly in the path of the cable 64. Instead, the tension sensor 233 is placed at a side of the cable 64, and can sense changes in tension of the cable 64 using one or more types of methods. The tension sensor 233 is placed at a position such that it can detect tension in the cable 64 by detecting particular characteristics or movements of cable 64 using electronics, optics, and/or other means. For example, the cable 64 may shudder or shake violently when there is a sudden and/or large change in tension. Such an action can be detected by the tension sensor 233 using optics to detect the shuddering or shaking movement of the cable 64. For example, a light emitting diode (LED) can be installed to emit light toward the tension sensor 233 when the lifting apparatus is being used, such that the light goes above and below cable 64. The tension sensor 233 can detect this light. When there is a violent shuddering or shaking of the cable 64, the light is blocked by the cable's sideways movement or shaking movement, and thus the tension sensor 233 will detect that there is a sudden change in tension. Here, when the tension of cable 64 changes by at least a predetermined amount, the tension sensor 233 sends a "stop" control signal to the device 6, to cause the device 6 to stop moving the travel platform 84. The "stop" control signal can be sent wirelessly to controller 276 from tension sensor 233, or the "stop" control signal can be sent by a wire or other means connecting tension sensor 233 and device 6.

The first and second ways of implementing the tension sensor 233 can be combined, so that the safety plungers 176, 178 extend outward into oval holes 174 and also the "stop" signal is sent to the device 6. Additional safety plungers can be added to the lifting apparatus.

FIG. 33 is a view of one embodiment of a lifting apparatus, in accordance with the principles and features set forth in the subject application, with a foldable travel platform in a low-profile position, with a locking handle in the unlocked position. The FIG. 33 shows the rail's 2, 4, 12, 14, front edge 27*a* of travel platform 84, rear edge 27*b* of travel platform 84, device 6, four call button switches 210 on rails, a hinge rod 220 for a platform hinge, a locking handle 212, hinge assembly 214, platform locking device 216, nuts and bolts 218, removable floor portion 26*a* of travel platform 84, and base floor portion 26*b* of travel platform 84.

There can be a situation where the travel platform 84 is on the first floor of a house, a person is on the second floor of the house, and that person wants to go down to the first floor with the assistance of the lifting apparatus. That person can press a call button switch 210 on a rail at the top of the lifting apparatus, as shown in FIG. 33, and then the travel platform 84 will then travel along the rails from the first floor to the person's location at the second floor. At that time, the person can get onto the travel platform 84 and ride the travel platform 84 down to the first floor.

In FIG. 33, an embodiment of the travel platform 84 which is foldable is depicted. This embodiment of the travel platform 84, as shown in FIG. 33, has a hinge rod 220 which is part of a hinge assembly 214 on the travel platform 84.

The foldable travel platform 84 has a standard position which is used when people and/or objects are transported on the travel platform 84. The standard position is depicted in FIGS. 29 and 34, for example.

The foldable travel platform 84 also has a low-profile position which is depicted in FIG. 33, for example. The low-profile position of the travel platform 84 helps to give the entire lifting apparatus a lower profile. This lower profile can make it easier to carry the lifting apparatus through a doorway in a house, for example. Also, this lower profile can make it easier to move the lifting apparatus or store the lifting apparatus, and can make it easier to transport the lifting apparatus by automobile or other vehicle.

When the travel platform 84 of FIG. 33 is in the standard position, the following steps can be performed to place the travel platform 84 in the low-profile position or folded position. Remove the bolts/nuts 218 from the platform locking device 216, hold the locking handle 212 and then pull the locking handle 212 outward away from the front edge 27*a* of the travel platform 84. At that time, the travel platform 84 can be folded down to the low-profile position.

The travel platform 84 can be disassembled if the hinge rod 220 is removed, as shown in FIG. 37. In order to disassemble the travel platform 84, the travel platform can first be moved from the standard position to the low-profile position, and then the hinge rod 220 can be removed, and then the removable floor portion 26*a* can be removed.

When the travel platform 84 is disassembled, as shown in FIG. 37, the lifting apparatus can be easier to carry through a doorway in a house, for example. Also, when the travel platform 84 is disassembled, as shown in FIG. 37, the lifting apparatus can be easier to move or store, and can be easier to transport by automobile or other vehicle.

When the travel platform 84 of FIG. 33 is in the low-profile position, the following steps can be performed to place the travel platform 84 in the standard position. Move the travel platform 84 up into the standard position, hold it there, install the bolts/nuts 218 at the platform locking device 216, and push the locking handle 212 inward toward the rear edge 27*b* of the travel platform 84. When the locking handle 212 is pushed inward in that way, the end portions 212*a*, 212*b* of the locking handle 212 go underneath the base floor portion 26*b* of the travel platform 84. At this time, the travel platform 84 will be securely held in the standard position. The end portions 212*a* and 212*b* of the locking handle 212 are shown in FIGS. 36A and 36B.

There are at least three different ways to hold the travel platform 84 up in the standard position. The nuts and bolts 218 can be used, the locking handle 212 shown in FIG. 33 can be used, and the support brackets 211 shown in FIG. 29 can be used. All three ways can be used together. However, it is preferred to use the brackets 211 and the nuts and bolts 218, without using the lifting handle 212.

FIG. 34 is a view of the lifting apparatus of FIG. 33, with the foldable travel platform in the standard position for transporting people and/or objects, with the locking handle in the locked position.

Figure 35:
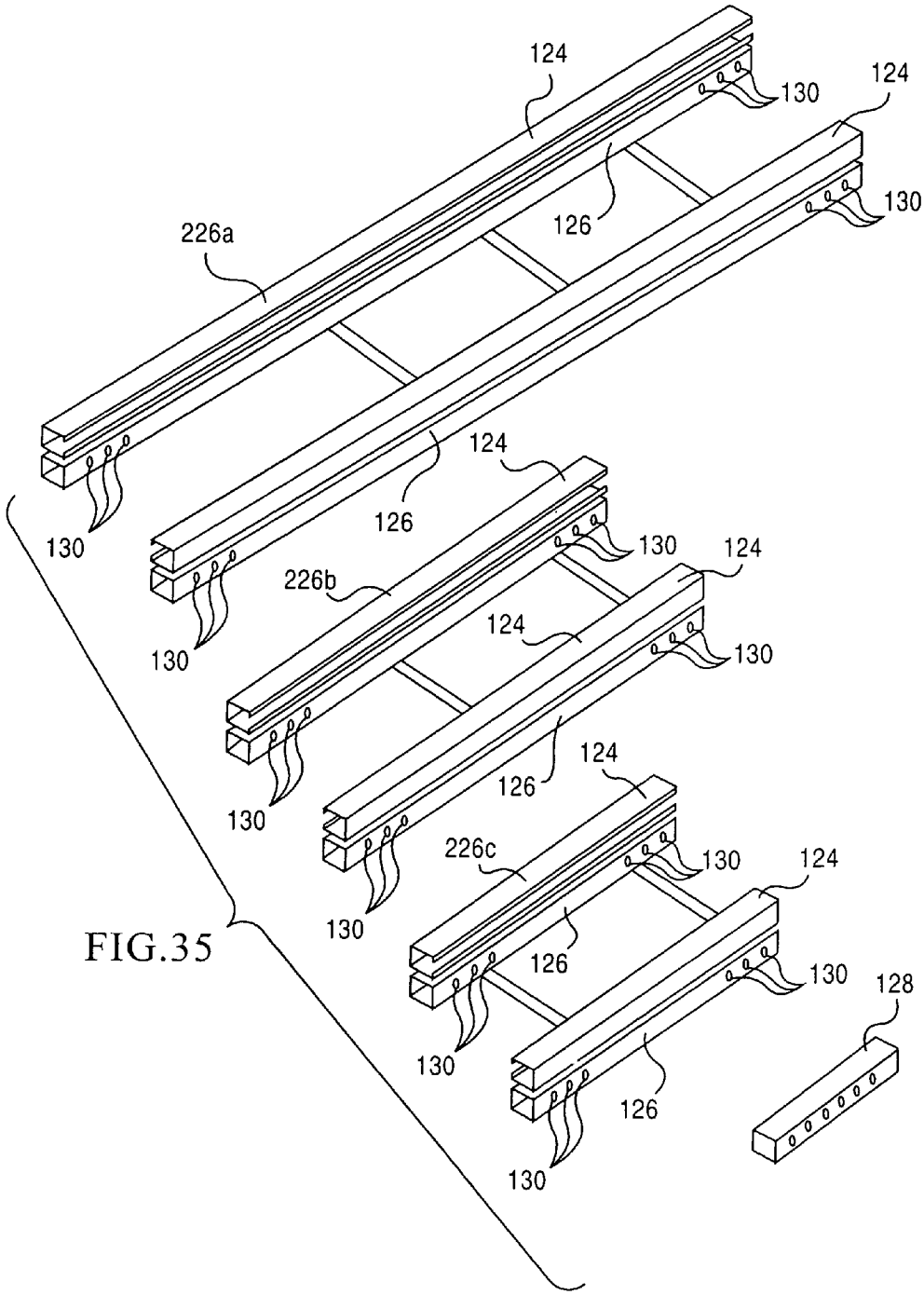
FIG. 35 is a view of different lengths of rails for one embodiment of a lifting apparatus, in accordance with the principles and features set forth in the subject application, which enable the lifting apparatus to fit over different staircases.

FIG. 35 is a view of different lengths of rails for one embodiment of a lifting apparatus, in accordance with the principles and features set forth in the subject application, which enable the lifting apparatus to fit over different staircases. The FIG. 35 shows upper rails 124, lower rails 126, holes 130, coupling bar 128, a long rail extension 226*a*, a medium-length rail extension 226*b*, and a short rail extension 226*c*.

The long rail extension 226*a* can be ten feet in length, for example. The medium-length rail extension 226*a* can be four feet in length, for example. The short rail extension 226*a* can be two feet in length, for example.

If a person wants to use the lifting apparatus to go up or down an extra long staircase, the lifting apparatus can be lengthened to fit the extra long staircase. For example, one or more rail extensions can be used to lengthen the lifting apparatus.

The general process of lengthening the lifting apparatus involves removing portions of the lifting apparatus, installing rail extensions of an appropriate size, and then the re-attaching the removed portions.

The process of lengthening the lifting apparatus by two feet can be described as follows.

First, the legs 8 are removed. FIG. 6A shows the legs 8 near the top of the lifting apparatus. FIG. 25 shows that holes 254 in the side of rail 4 enable the leg 8 to be relocated.

Second, the pulleys 66 and 68 are removed. FIG. 6A shows pulleys 66 and 68. FIG. 6A shows that holes 72 in rails enable the pulleys to be relocated. See also the holes 72 in FIG. 9.

Third, one coupling bar 128 is inserted into rail 4 and another coupling bar 128 is inserted into rail 14. Coupling bars 128 are depicted in FIGS. 9 and 35. The coupling bars 128 are then attached to rails 4 and 14 using fasteners. For example, to secure a coupling bar 128 to a rail 4, a hole 122 in rail 4 can be aligned with a hole 76 in a coupling bar 128. See FIG. 9. After the holes are aligned, a bolt can be passed into the hole 122 on a first side of rail 4, through the hole 76 in the coupling bar 128, and then through a hole 122 on the opposite side of the rail 4. A nut and washer can then be used to hold the bolt in place. Nuts and bolts are not the only types of fasteners that can be used. Other types of fasteners can be used. The coupling bars 128 are attached in a manner that leaves adequate portions of the coupling bars 128 extending out from rails 4 and 14.

Fourth, the two foot rail extension 226*c* is attached to the portions of the coupling bars 128 that are extending out from rails 4 and 14. The rail extension 226*c* is shown in FIG. 35. The rail extension 226*c* is attached to coupling bars 128 using fasteners. For example, to secure rail extension 226*c* to a coupling bar 128, a hole 130 in the extension rail 226*c* can be aligned with a hole 76 in a coupling bar 128. See FIG. 9. After the holes are aligned, a bolt can be passed into the hole 130 on a first side of rail extension 226*c*, through the hole 76 in the coupling bar 128, and then through a hole 130 on the opposite side of the rail extension 226*c*. A nut and washer can then be used to hold the bolt in place. Nuts and bolts are not the only types of fasteners that can be used. Other types of fasteners can be used.

Fifth, the pulley assemblies 66 and 68 are attached to the extension rail 226*c* using holes 72 in the extension rail 226*c*, and the legs 8 are attached to extension rail 226*c* using holes 130 in a side the extension rail 226*c*. The holes 130 in rail 126 are shown in FIGS. 9 and 35. The holes 254 are shown in FIG. 25. The holes 130 are similar to holes 254. The holes 130 can be used to mount a leg 8 to extension rail 226*c*, in the same manner that the holes 254 can be used to mount a leg 8 to rail 4.

FIG. 36A is a view of portions of a regular-sized foldable travel platform of one embodiment of a lifting apparatus, in accordance with the principles and features set forth in the subject application. The FIG. 36A shows an item corresponding to reference numeral 222, which is an 18 inch removable floor portion 26*a* of a foldable travel platform 84, locking handle 212, end portions 212*a*, 212*b*, and hinge rod 220.

FIG. 36B is a view of portions of a large-sized foldable travel platform of one embodiment of a lifting apparatus, in accordance with the principles and features set forth in the subject application. The FIG. 36B shows an item corresponding to reference numeral 224, which is a 36 inch removable floor portion 26*a* of a foldable travel platform 84, locking handle 212, and end portions 212*a*, 212*b*. The 18 inch unit 222 and the 36 inch unit 224 are interchangeable. Other sizes can also be used.

A travel platform 84 can be resized using the extension rod 162 and other components as shown in FIG. 16. However, a use of the extension rod 162 is not the preferred method of resizing a travel platform 84. The preferred method of resizing a travel platform 84 is to take away the undesired removable floor portion 26*a*, and then install the desired size of the removable floor portion 26*a*. For example, an 18 inch removable floor portion 26*a* is shown in FIG. 36A, and a 36 inch removable floor portion 26*a* is shown in FIG. 36B.

FIG. 37 is a view of the lifting apparatus of FIG. 33, with portions of the foldable travel platform removed.

Figure 38:
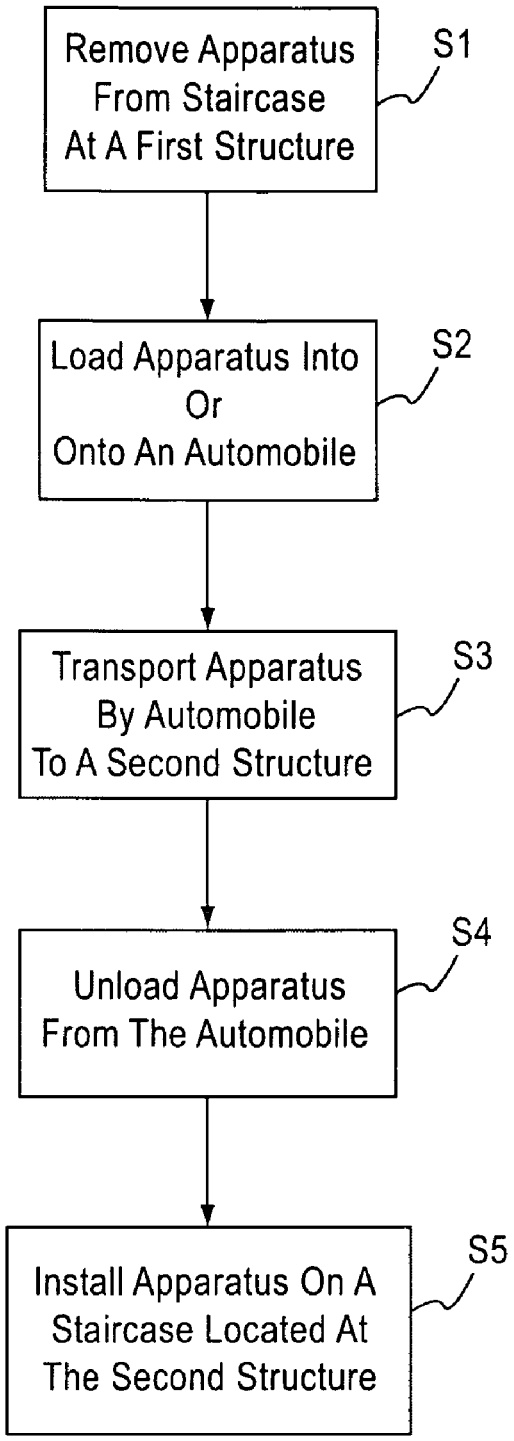
FIG. 38 is a flowchart showing steps relating to removing, loading, transporting, unloading, and installing a lifting apparatus, in accordance with the principles and features set forth in the subject application.

FIG. 38 is a flowchart showing steps relating to removing, loading, transporting, unloading, and installing a lifting apparatus, in accordance with the principles and features set forth in the subject application. A lifting apparatus, in accordance with the principles and features set forth in the subject application, can be installed at a staircase at a first structure. The first structure may be a first house, for example. At step S1, this occurs: remove the lifting apparatus from a staircase at the first structure. At step S2, this occurs: load the lifting apparatus into or onto a vehicle, such as an automobile. At step S3, this occurs: transport the lifting apparatus by automobile to a second structure. The second structure may be a second house, for example. At step S4, this occurs: unload the lifting apparatus from the automobile. At step S5, this occurs: install lifting apparatus on a staircase at the second structure.

Rail 4 provide extra support below rail 2. Rail 14 provides extra support below rail 12. When rails 2 and 12 are made of a material with particular dimensions that can adequately support the travel platform 84 and enable the platform 84 to move in the manner as described above, then rails 4 and 14 would not be needed. Thus, rails 4 and 14 would be optional.

As discussed above, there are various ways to change the size of the lifting apparatus. The width of the lifting apparatus, that is width of the rails 2, 4, 12, and 14 and the width of the travel platform 84, can be set to be wide or narrow. It can be set to be narrow enough so that some people can use the lifting apparatus to go up and down a staircase 16 while other people simultaneously walk up and down that same staircase 16. The width of the lifting apparatus can be set to be narrow, which leaves an adequate amount of space on the staircase 16 for people who want to walk up and down the stairs. Also, the width of the lifting apparatus can be set to be wide enough to be able to carry more than one person, to carry a large refrigerator, to carry an oversized wheelchair, or other items.

A foot 10 near the top of the lifting apparatus can be made of rubber or other material to help prevent slippage and other movement, and also to help prevent scratches or other damage to carpeting, wood, or other surface material.

A cushion 194 near the bottom of the lifting apparatus can be made of rubber or other material to help prevent slippage and other movement, and also to help prevent scratches or other damage to carpeting, wood, or other surface material.

The device 6 shown in FIG. 22 includes a recharging circuit, so that batteries 196 will be recharged when an external power source is connected to plug 208. A basic device 6 is shown in FIG. 6A. A device 6 with more advanced features is shown in FIGS. 22 and 23.

The holes 174 can be enlarged or modified as needed, to alter or improve stopping ability. For example, the oval holes 174 could be enlarged and changed to oval slots.

The lifting apparatus is arranged so that the floor portion 26 of the travel platform 84 will be level with the floor at the top of the staircase 16. This enables a person in a wheelchair to smoothly and easily roll off the floor portion 26 to the second floor of a house, for example, without encountering any significant bump or impediment. This also enables a person in a wheelchair to smoothly and easily roll onto the floor portion 26 from the second floor of a house, for example, without encountering any significant bump or impediment. This is helpful for a person using a walker, which is a tool for disabled people who need to lean on something to maintain balance or stability while walking. This is also helpful for someone who has trouble walking and cannot lift their feet very high while walking. Thus, a person can get on and off the travel platform 84 at the top of a staircase 16 without assistance from another person.

The lifting apparatus is arranged so that the floor portion 26 of the travel platform 84 will be level with the floor at the bottom of the staircase 16. This enables a person in a wheelchair to smoothly and easily roll off the floor portion 26 to the first floor of a house, for example, without encountering any significant bump or impediment. This also enables a person in a wheelchair to smoothly and easily roll onto the floor portion 26 from the first floor of a house, for example, without encountering any significant bump or impediment. This is helpful for a person using a walker. This is also helpful for someone who has trouble walking and cannot lift their feet very high while walking. Thus a person can get on and off the travel platform 84 at the bottom of a staircase 16 without assistance from another person.

The cable 64 can be a ⅛" steel cable, but is not limited only to that size or that material. Other types of materials can be used in place of steel. The rails 2, 4, 12, and 14 can be made to be any length needed, to adequately fit over a staircase 16.

The cross-bars 20 can be made of flat metal that is ⅜ inch thick and that is one inch in width. The rails 2, 4, 12, and 14 can be made 1.5 inches wide, 1.5 inches high, and 10 feet long, and can be made of steel. However, the rails are not limited only to those dimensions and material. The rails can be made of different material and can be made to have other dimensions.

The lifting apparatus can be carried by automobile, in the same manner that a ladder would be carried by automobile.

Figure 39:
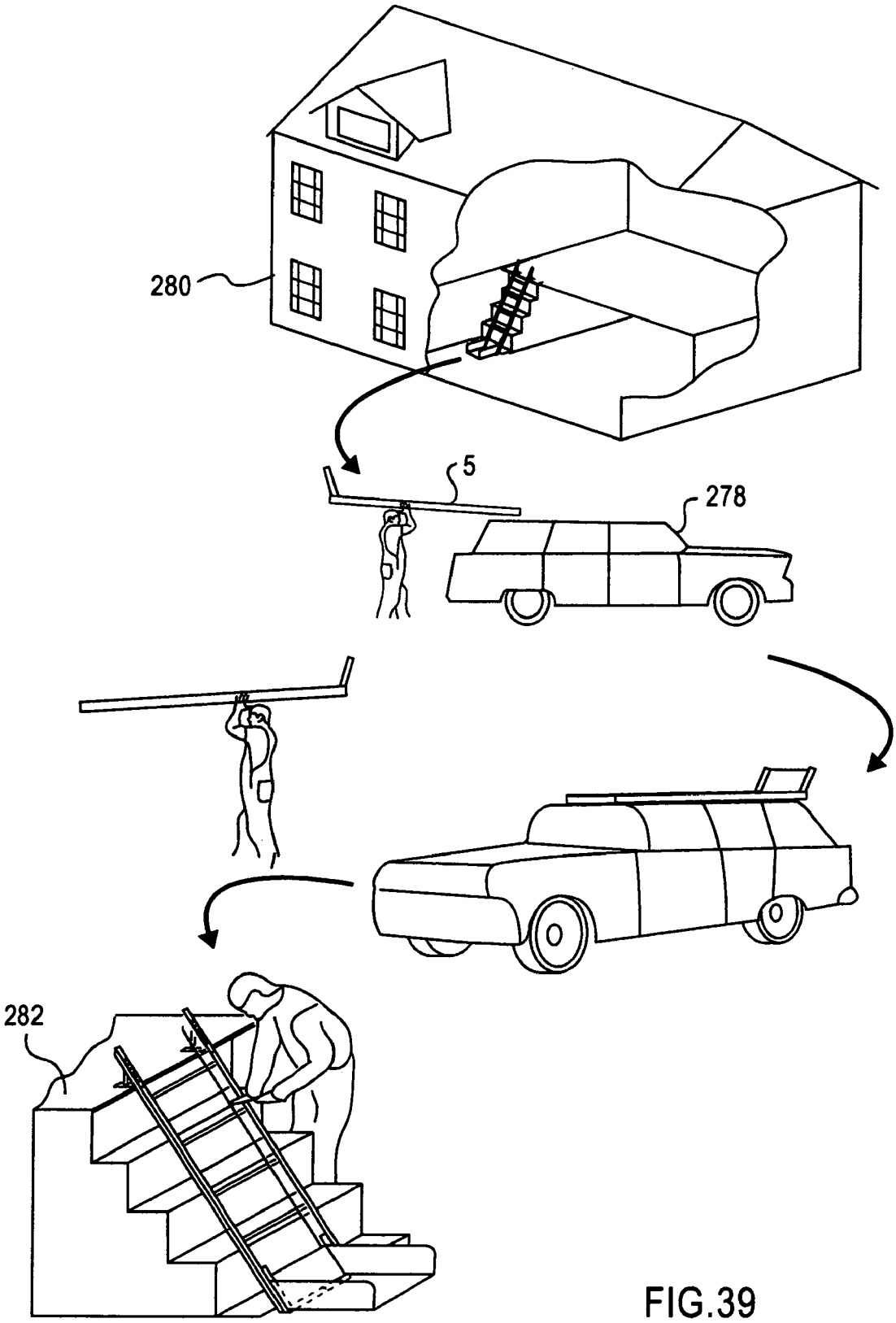
FIG. 39 shows an example of a lifting apparatus, first structure, second structure, and automobile, in accordance with the principles and features set forth in the subject application.

FIG. 39 shows an example of a lifting apparatus, first structure, second structure, and automobile, in accordance with the principles and features set forth in the subject application. A lifting apparatus 5, in accordance with the principles and features set forth in the subject application, can be installed at a staircase at a first structure 280. The first structure 280 may be a first house, for example. The lifting apparatus 5 can be removed from the staircase at the first structure 280, and then loaded into or onto a vehicle, such as an automobile 278. The lifting apparatus 5 can be transported by automobile 278 to a second structure 282. The second structure 282 may be a second house, for example. The lifting apparatus 5 can be unloaded from the automobile 278, and then installed at a staircase at the second structure 282.

The device 6 does not need to be mounted to the lifting apparatus 5 near the lowest stair of a staircase 16, for example. The device 6 can be mounted near a top of the lifting apparatus 5, or near a middle of the lifting apparatus 5, for example.

In one embodiment of the lifting apparatus, all pulleys and pulley assemblies are positioned at an interior of these components: 2, 4, 12, 14, 21, and 36. In another embodiment of the lifting apparatus, one or more of those pulleys and pulley assemblies are positioned at an exterior of those components.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and methods, and illustrative examples shown and described. Accordingly, departures may be made from such details without departing from the spirit and scope of the applicant's general inventive concept.

LIST OF COMPONENTS

2 Upper rail, left side
4 Lower rail, left side
5 Lifting apparatus
6 Winch, device
8 Leg at top of rails
10 Foot for leg at top of rails
12 Upper rail, right side
14 Lower rail, right side
16 Staircase
18 Weld between upper and lower rails

20 Cross-bar between rails
21 Bar
22 Upright portion on travel platform, left side
24 Upright portion on travel platform, right side
26 Floor portion of travel platform
26*a* Removable floor portion of travel platform
26*b* Base floor portion of travel platform
27*a* Front edge of floor portion 26
27*b* Rear edge of floor portion 26
28 Side wall of travel platform, right side
30 Side wall of travel platform, left side
32 Handrail of travel platform, right side
34 Handrail of travel platform, left side
36 Support piece under front edge of travel platform
38 Wheel assembly for travel platform, upper left position
40 Wheel assembly for travel platform, lower left position
42 Wheel assembly for travel platform, upper right position
44 Wheel assembly for travel platform, lower right position
46*a* Control unit, basic model, located on handrail at right side of travel platform
46*b* Control unit, basic model, located on handrail at left side of travel platform
46*c* Control unit, advanced model, located on handrail at left side of travel platform
46*d* Remote control unit, advanced model, hand-held or located on handrail of travel platform
48 Head of bolt
50 Washer
52 Washer
54 Washer
56 Nut
58 Shaft of bolt
60 Washer
62 Nut
64 Steel cable
66 Pulley located near top of rail, left side
68 Pulley located near top of rail, right side
70 Pulley mounted to platform, centrally located between left-side and right-side rails
72 Holes in upper and lower rails, for receiving bolts to mount pulleys in interior of upper rails
74 Holes in upright portions of travel platform, for receiving shafts of wheel assemblies to mount the wheel assemblies
76 Holes in coupling bar, for receiving bolts to mount extension rails to lower rails
78 Holes in control unit and handrail, for receiving bolts to mount control unit to handrail
80*a* Control switch on control unit on right handrail
80*b* Control switch on control unit on left handrail
82 Weld between lower rail and cross bar
84 Travel platform
86 Cable portion
88 Cable portion
90 "Y" Cable attachment portion
91 Cable attachment portion
92 Pulley assembly
100 Head of bolt
102 Washer
104 Housing for pulley assembly
106 Portion of wheel assembly (shield)
108 Rotating wheel of pulley assembly
110 Rotating wheel of pulley assembly
112 Portion of wheel assembly (shield)
114 Shaft of bolt
116 Washer
118 Nut
120 End of shaft of bolt
121 Hole in wall of support piece 36
122 Holes in lower rails, for receiving bolts to mount extension rails to lower rails
124 Upper rail of extension rail
126 Lower rail of extension rail
128 Coupling bar
130 Holes in rail extension, for attaching coupling bar to rail extension
132 Safety gate at back of travel platform, located between handrails of travel platform
134 Safety gate at front of travel platform, located between handrails of travel platform
136 Electric cable connected to control unit located on handrail of travel platform
138 Plug connection between extension cable and electric cable connected to control unit located on handrail of travel platform
140 Extension cable
142 Plug connection between extension cable and electric cable connected to remote control unit
144 Electric cable connected to remote control unit
146 Fastener for attaching control unit to handrail of travel platform
148 "Up" control switch on control unit
150 "Speed Control" control switch on control unit
152 "Down" control switch on control unit
153 Authorization unit
154*a* Base portion on travel platform, for mounting front of right-side handrail
154*b* Base portion on travel platform, for mounting rear of right-side handrail
156*a* Base portion on travel platform, for mounting front of left-side handrail
156*b* Base portion on travel platform, for mounting front of left-side handrail
158 Hinge or pivot for safety gate at back of travel platform
160 Holder mounted on back portion of right-side handrail, for holding safety gate when safety gate is closed
162 Extension rod used to increase the size of the travel platform
164 Safety unit
166 Switch under floor portion of travel platform, for hinged unit
168 Spring located under floor portion of travel platform, for hinged unit
170 Hinged unit under floor portion of travel platform
172 Hinge for hinged unit
174 Holes in upper rails, for receiving safety plunger when cable fails
176 Safety plunger at right side
178 Safety plunger at left side
180*a* Spring for safety plunger, in more compressed state, when cable has not failed and safety plunger is in a retracted state
180*b* Spring for safety plunger, in less compressed state, when cable has failed and safety plunger is in an extended state
182 Pivoting foot for bottom of rails
184 Pivot for leg at top of rails
186 Pivot portion of leg at top of rails
188 Threaded cylinder for leg at top of rails
190 Threaded shaft for leg at top of rails
192 Switch allowing for AC operation or DC battery operation
194 Rubber cushion on bottom of pivoting foot at bottom of rails
196 Battery

198 AC/DC converter
200 Motor
202 Fly wheel
204 Motor gear unit
206 Cable take up reel
208 plug for external power source
210 Call button switch
211 Support bracket
212 Locking handle for travel platform unit
212*a* End portion of locking handle
212*b* End portion of locking handle
214 Hinge assembly for platform unit
216 Platform locking device
218 Bolt and nut to lock platform unit
220 Hinge rod for platform hinge
222 Optional size platform 18"
224 Optional size platform 36"
226*a* Optional rail extension 10'
226*b* Optional rail extension 4'
226*c* Optional rail extension 2'
227*a* Braking unit, first embodiment
227*b* Braking unit, second embodiment
228 Spring stop plate
230 Spring stop plate weld
232 Spring pull lock
233 Tension sensor
234 Safety plunger connection rod left side
236 Safety plunger connection rod adjustable connection
238 Lock nut safety plunger adjustable connection rod
240 Safety plunger tension spring
242 Safety plunger lever stop
244 Safety plunger control unit arm
246 Safety plunger control unit mount
248 Safety plunger control unit bolt
250 Safety plunger weld
252 Connect rod control unit to safety plunger
254 Holes for mounting legs at different positions
256 Lugs for mounting winch to one or more rails
258 Optional seat unit—rotates 360°
260 Mount for seat unit
262 Screws to mount seat unit to platform
264 Seat belt
266 Seat belt lock device
268 Seat belt buckle
270 Seat unit hand rails
272 Weld at seat support
274 Seat unit back support
276 Controller
278 Automobile
280 First structure
282 Second structure

What is claimed is:

1. An apparatus configured to be removably placed over a staircase between an upper floor and a lower floor of a first structure, the apparatus comprising:

a first rail configured to be removably placed over the staircase at said first structure, wherein said first rail includes a lower portion welded to an upper portion;

a second rail configured to be removably placed over the staircase, said second rail being substantially parallel to said first rail at said first structure, wherein said second rail includes a lower portion welded to an upper portion;

legs being coupled to said first and second rails, said legs resting on the upper floor, wherein bottoms of said rails are resting on the lower floor;

a plurality of cross-bars coupling said first and second rails to each other, wherein a distance from said first rail to said second rail is less than a width of the staircase at the first structure;

a cable having a first end and a second end;

a device retracting and extending said cable in dependence upon a control signal, said device being at a position above the staircase and being fixed to said first and second rails and being supported by said first and second rails;

a platform being movably coupled to said first and second rails, said platform being coupled to said cable, said platform being moved along said first and second rails in dependence upon the retracting and extending of said cable, said platform having a front edge and a rear edge, said platform comprising:

a floor portion which can support an object, wherein said object is a wheelchair;

a plurality of upright portions being parallel to said first and second rails and extending above said floor portion;

a plurality of wheels mounted to said upright portions, said wheels rotating inside said upper portions of said first and second rails;

a support piece being parallel to said cross-bars; and a second plurality of wheels mounted inside said support piece, said cable contacting said second plurality of wheels; and at least one control unit having a switch, said at least one control unit outputting said control signal to said device in dependence upon operation of said switch, wherein said first and second rails are arranged to form a space between portions of said first and second rails at and above the upper floor, wherein the space is not obstructed by said rails, cross-bars, cable, or device, wherein the space can accommodate said wheelchair when said wheelchair is rolled between said first and second rails off said platform and onto the upper floor, said front edge of said platform being positioned on the lower floor when said wheelchair is rolled from the lower floor onto said platform without being obstructed by said rails, cross-bars, cable, or device, said platform supporting said wheelchair when said platform is moved along said first and second rails up to the upper floor, and said rear edge of said platform being positioned level with the upper floor when said wheelchair is rolled, through the space formed between said first and second rails, from said platform onto the upper floor, wherein a further rail is not needed, wherein the apparatus is configured to be installed over the staircase at said first structure, the installation of the apparatus corresponding to placing the apparatus over the staircase at said first structure, the apparatus is configured to be removed from said staircase of said first structure wherein the removal of the apparatus corresponds to lifting the apparatus up away from said staircase at said first structure, the apparatus is configured to be transported by an automobile from said first structure to a second structure after the apparatus is removed from said staircase at said first structure, the apparatus is configured to be installed over a staircase between two floors in said second structure, and the apparatus is configured to be operated to use said platform to transport said wheelchair over said staircase in said second structure from one of said two floors to the other one of said two floors in said second structure, wherein the installation, operation, and removal of the apparatus are performed without substantially modifying any wall, stair, floor, or other surface with fasteners.

2. An apparatus configured to be removably placed over a staircase between an upper floor and a lower floor of a first structure, the apparatus comprising:

a first rail configured to be removably placed on top of the staircase;

a second rail configured to be removably placed on top of the staircase, said second rail being substantially parallel to said first rail;

legs being coupled to said first and second rails, said legs resting on the upper floor of said first structure, wherein bottoms of said rails are resting on the lower floor of said first structure;

a cable having a first end and a second end;

a device retracting and extending said cable in dependence upon a control signal, said device being at a position above the staircase and being fixed to said first and second rails;

a platform being movably coupled to said first and second rails, said platform being coupled to said cable, said platform being moved along said first and second rails in dependence upon the retracting and extending of said cable, said platform having a front edge and a rear edge, said platform comprising:

a floor portion which can support an object;

a support piece; and a plurality of wheels mounted inside said support piece, said cable contacting said plurality of wheels; and at least one control unit having a switch, said at least one control unit outputting said control signal to said device in dependence upon operation of said switch, wherein said first and second rails are arranged to form a space between portions of said first and second rails at and above the upper floor, wherein the space accommodates an object or individual when said object or individual moves between said first and second rails off said platform and onto the upper floor, said front edge of said platform being positioned on the lower floor when said object or individual moves from the lower floor onto said platform, said platform supporting said object when said platform is moved along said first and second rails up to the upper floor, and said rear edge of said platform being positioned level with the upper floor when said object or individual moves, through the space formed between said first and second rails, from said platform onto the upper floor.

3. The apparatus of claim 2, said platform further comprising:

a braking unit coupled to said cable, said braking unit including at least one safety plunger, said at least one safety plunger extending into one of a plurality of orifices formed by said first rail when said cable fails, wherein said platform stops moving when said at least one safety plunger extends into one of said orifices.

4. The apparatus of claim 3, said braking unit comprising:

a tension sensor sensing changes in tension of said cable, said tension sensor causing said at least one safety plunger to extend into one of said orifices when said tension sensor detects a change in the tension of said cable that is larger than a predetermined amount.

5. The apparatus of claim 2, said platform further comprising:

a first upright portion;

a second upright portion being substantially parallel to said first upright portion;

said support piece fixed between said first and second upright portions;

a first pair of wheels coupled to said first upright portion; and a second pair of wheels coupled to said second upright portion, wherein said floor portion has two side walls, said floor portion and two side walls being fixed to said support piece and first and second upright portions.

6. The apparatus of claim 5, said plurality of wheels comprising:

at least one pulley mounted inside said support piece, said cable being conveyed through said support piece and around said at least one pulley.

7. The apparatus of claim 5, wherein said first rail includes a first upper rail and a first lower rail, and said first pair of wheels is positioned inside said first upper rail.

8. The apparatus of claim 2, wherein the apparatus is configured to be lifted up and carried.

9. The apparatus of claim 8, wherein the apparatus is configured to be installed at the staircase at said first structure, the installation of the apparatus corresponding to placing the apparatus over the staircase at said first structure, the apparatus is configured to be operated to use said platform to transport said object or individual over said staircase from one of the upper and lower floors to the other one of the upper and lower floors, and the apparatus is configured to be removed from said staircase, the removal of the apparatus corresponding to lifting the apparatus up away from said staircase at said first structure, the apparatus is configured to be transported by an automobile from said first structure to a second structure, after the apparatus is removed from said staircase in said first structure, the apparatus is configured to be installed at a staircase between two floors in said second structure, and the apparatus is configured to be operated to use said platform to transport said object or individual over said staircase from one of said two floors to the other one of said two floors in said second structure.

10. The apparatus of claim 2, wherein said platform is moved from a first location to a second location along said first and second rails in dependence upon the retracting and extending of said cable, and said device is fixed to said first and second rails at a first position, said first position being between said first and second locations.

11. The apparatus of claim 2, said platform further comprising:

a hinged unit mounted below said floor portion; and a safety switch unit outputting a safety signal to said control unit when said hinged unit moves toward said floor portion, wherein said device stops the retracting and extending of said cable when said safety signal is output.

12. The apparatus of claim 2, wherein said object corresponds to a wheelchair.

13. An apparatus configured to be removably placed over a staircase between an upper floor and a lower floor, the apparatus comprising:

a pair of rails configured to be removably placed on top of the staircase;

legs being coupled to said rails, said legs resting on a first surface, wherein bottom of said rails are resting on a second surface;

a plurality of cross-bars coupling said rails to each other at positions below said legs;

a device reeling and unreeling a cable, said device being mounted to said rails at a position below the first surface, said device being at a position above the staircase and being supported by said rails;

a platform being movably coupled to said pair of rails, said platform being moved in dependence upon the reeling and unreeling of the cable, said platform being moved along said rails from a first position where said platform is level with the first surface to a second position where said platform is on the second surface, said platform comprising:

a floor portion supporting an object;

a plurality of upright portions being parallel to said rails;

a plurality of wheels mounted to said upright portions, said wheels rotating inside said rails;

a support piece being parallel to said cross-bars; and a second plurality of wheels mounted inside said support piece, the cable contacting said second plurality of wheels, wherein a portion of said rails defines a space extending upwards from the first surface and between said rails, the space accommodating an object moved between said rails from said platform to the first surface when said platform is level with the first surface.

* * * * *